US009892664B2

(12) United States Patent
Logan et al.

(10) Patent No.: US 9,892,664 B2
(45) Date of Patent: Feb. 13, 2018

(54) SIGN HOLDER ASSEMBLY WITH MOUNTING MEMBER

(71) Applicant: TARGET BRANDS, INC., Minneapolis, MN (US)

(72) Inventors: Robert G. Logan, Blaine, MN (US); Jeremy A. Clark, Minneapolis, MN (US); David H. Cheney, Shoreview, MN (US); Jason L. Dusbabek, Elk River, MN (US); Paul A. Schlough, Andover, MN (US)

(73) Assignee: TARGET BRAND, INC., Minneapolis, MN (US)

( * ) Notice: Subject to any disclaimer, the term of this patent is extended or adjusted under 35 U.S.C. 154(b) by 13 days.

(21) Appl. No.: 15/234,666

(22) Filed: Aug. 11, 2016

(65) Prior Publication Data

US 2016/0351088 A1 Dec. 1, 2016

Related U.S. Application Data

(63) Continuation of application No. 14/860,379, filed on Sep. 21, 2015, now Pat. No. 9,424,764, which is a continuation of application No. 13/860,386, filed on Apr. 10, 2013, now Pat. No. 9,142,150.

(60) Provisional application No. 61/622,353, filed on Apr. 10, 2012.

(51) Int. Cl.

| | |
|---|---|
| ***G09F 7/00*** | (2006.01) |
| ***G09F 7/20*** | (2006.01) |
| ***G09F 7/18*** | (2006.01) |
| ***G09F 7/08*** | (2006.01) |
| ***G09F 7/10*** | (2006.01) |

(52) U.S. Cl.

CPC ..... *G09F 7/20* (2013.01); *G09F 7/00* (2013.01); *G09F 7/08* (2013.01); *G09F 7/10* (2013.01); *G09F 7/18* (2013.01); *G09F 2007/1852* (2013.01); *Y10T 29/49826* (2015.01)

(58) Field of Classification Search

CPC ..... G09F 7/02; G09F 7/10; G09F 7/08

See application file for complete search history.

(56) References Cited

U.S. PATENT DOCUMENTS

| | | | |
|---|---|---|---|
| 2,557,262 | A | 6/1951 | Cordes |
| 2,769,553 | A | 11/1956 | Horton |
| 2,876,359 | A | 3/1959 | Plymale |
| 2,901,849 | A | 9/1959 | Callison |

(Continued)

*Primary Examiner* — Cassandra H Davis

(74) *Attorney, Agent, or Firm* — JoAnn M. Seaton; Griffiths & Seaton PLLC

(57) ABSTRACT

A sign holder assembly comprises a cross bar and a mounting member. The mounting member is selectively coupled with the cross bar and includes a front panel, at least two elongated reception channels, a first flange, and a second flange. Each of the at least two elongated reception channels is sized and shaped to sit over and extend at least partially around the cross bar to couple the mounting member to the cross bar. The first flange is offset from and extends substantially parallel to the front panel; the first flange defines a free top edge of the mounting member. The second flange is substantially coplanar with and extends in an opposite direction as the first flange to define a free bottom edge of the mounting member opposite the free top edge. The first flange and the second flange are configured to collectively receive a sign holder support member.

16 Claims, 37 Drawing Sheets

(56) References Cited

U.S. PATENT DOCUMENTS

| | | | | |
|---|---|---|---|---|
| 3,166,042 | A | 1/1965 | Hill | |
| 3,208,170 | A | 9/1965 | Madey | |
| 3,296,725 | A | 1/1967 | Fenwick | |
| 3,429,546 | A | 2/1969 | Porter | |
| 3,497,081 | A | 2/1970 | Field | |
| 3,516,552 | A | 6/1970 | Salava | |
| 3,608,741 | A | 9/1971 | Schray | |
| 3,703,964 | A | 11/1972 | Field | |
| 3,797,151 | A | 3/1974 | Dexter | |
| 4,190,167 | A | 2/1980 | Wells et al. | |
| 4,344,244 | A * | 8/1982 | Tyke | G09F 3/18 40/490 |
| 4,472,897 | A | 9/1984 | Phillips | |
| 4,531,472 | A | 7/1985 | Marrero et al. | |
| 4,618,063 | A | 10/1986 | Mendenhall | |
| 4,672,757 | A | 6/1987 | Field | |
| 4,677,780 | A | 7/1987 | Shuman | |
| 4,776,116 | A | 10/1988 | Shuman | |
| 4,783,921 | A | 11/1988 | George | |
| 4,798,013 | A | 1/1989 | Sainato | |
| 4,884,351 | A | 12/1989 | Abramson | |
| 4,960,258 | A | 10/1990 | Stocker et al. | |
| 5,109,992 | A | 5/1992 | Miller | |
| 5,197,215 | A | 3/1993 | Torsleff | |
| 5,241,767 | A | 9/1993 | Fuda et al. | |
| 5,257,472 | A | 11/1993 | Harnois et al. | |
| 5,381,991 | A | 1/1995 | Stocker | |
| 5,388,359 | A | 2/1995 | DeWitt | |
| 5,400,992 | A | 3/1995 | Pohl | |
| 5,437,116 | A | 8/1995 | Hardy | |
| 5,472,163 | A | 12/1995 | Callas | |
| 5,577,337 | A | 11/1996 | Lin | |
| 5,609,317 | A | 3/1997 | Glynn et al. | |
| 5,664,749 | A | 9/1997 | Kump et al. | |
| 5,803,420 | A | 9/1998 | Conway et al. | |
| 5,930,926 | A | 8/1999 | Kaplan | |
| 5,931,301 | A | 8/1999 | Hadden et al. | |
| 5,975,318 | A | 11/1999 | Jay | |
| 6,006,678 | A | 12/1999 | Merit et al. | |
| 6,015,124 | A | 1/2000 | Loy | |
| 6,059,124 | A | 5/2000 | Weck et al. | |
| 6,092,320 | A | 7/2000 | Bringuet | |
| 6,289,618 | B1 | 9/2001 | Kump et al. | |
| 6,349,507 | B1 | 2/2002 | Muellerleile | |
| 6,381,890 | B1 | 5/2002 | Sjostedt | |
| 6,430,857 | B1 | 8/2002 | Nagel | |
| 6,571,498 | B1 | 6/2003 | Cyrluk | |
| 6,578,302 | B1 | 6/2003 | Benaquista et al. | |
| 6,685,037 | B1 | 2/2004 | Zadak | |
| 6,945,414 | B1 | 9/2005 | Stevens et al. | |
| 6,976,331 | B2 | 12/2005 | Fast | |
| 7,367,149 | B2 | 5/2008 | Fast et al. | |
| 7,717,279 | B2 | 5/2010 | Lawson | |
| 7,798,338 | B2 | 9/2010 | Maheu et al. | |
| 7,882,969 | B2 | 2/2011 | Gerstner et al. | |
| D634,861 | S | 3/2011 | Whittier et al. | |
| 8,191,295 | B2 | 6/2012 | Junkins et al. | |
| 8,234,805 | B2 | 8/2012 | Dukes et al. | |
| D704,269 | S | 5/2014 | Logan et al. | |
| 8,832,982 | B1 | 9/2014 | Bacskai et al. | |
| 2002/0166275 | A1 | 11/2002 | Broadwell et al. | |
| 2005/0016039 | A1 | 1/2005 | Abramson | |
| 2008/0116159 | A1 | 5/2008 | Chu | |
| 2008/0172917 | A1 | 7/2008 | Brandow et al. | |
| 2009/0056185 | A1 | 3/2009 | Wamsley | |
| 2011/0219653 | A1 | 9/2011 | Shea et al. | |
| 2011/0277363 | A1 | 11/2011 | Dukes et al. | |

* cited by examiner

SIGN HOLDER ASSEMBLY WITH MOUNTING MEMBER

CROSS-REFERENCE TO RELATED APPLICATION

This application is a continuation of U.S. patent application Ser. No. 14/860,379, filed Sep. 21, 2015, which is a continuation of U.S. patent application Ser. No. 13/860,386, filed Apr. 10, 2013, which is a non-provisional application of and claims priority under 35 U.S.C. § 119(e) to U.S. Provisional Patent Application No. 61/622,353, filed Apr. 10, 2012, all of which are incorporated herein by reference. This application is related to U.S. patent application Ser. No. 15/234,709, filed Aug. 11, 2016.

BACKGROUND OF THE INVENTION

Retail businesses typically use a wide variety of display systems to display products and related information to consumers. In order to draw attention to the products displayed and/or to assist the consumer in locating the particular product for which they are searching, additional signs or other indicating means are becoming increasingly important. Such signs are typically mounted to the display systems to indicate the type of product, brand of product, advertising, sale status indicator, department, or other information relating to the displayed products and generally helpful to the consumer.

The above-described signs are generally positioned to correspond with particular products placed upon shelves, pegs, or other display devices. Preferably, such signs are securely mounted to the shelf or display system, are effective in communicating the indicated information such as the product type, brand name, logo, etc., to the consumer, and are aesthetically pleasing to consumers so as not to distract from the product display itself. To accomplish such goals, a retail business has been typically required to maintain a very large inventory of sign holders and associated hardware given the many different types of sign holders and display fixtures used in a given retail setting.

SUMMARY

One embodiment of the invention relates to a sign holder assembly comprising a cross bar and a mounting member. The cross bar is secured in a retail display. The mounting member is selectively coupled with the cross bar and includes a front panel, at least two elongated reception channels, a first flange, and a second flange. The at least two elongated reception channels extend substantially in parallel with each other and the front panel. Each of the at least two elongated reception channels is open toward a first direction is sized and shaped to sit over and extend at least partially around the cross bar to couple the mounting member to the cross bar. The first flange is offset from and extends substantially parallel to the front panel; the first flange defines a free top edge of the mounting member. The second flange is substantially coplanar with and extends in an opposite direction as the first flange to define a free bottom edge of the mounting member opposite the free top edge. The first flange and the second flange are configured to collectively receive a sign holder support member on an opposite side of the front panel as compared to the at least two elongated reception channels. Other embodiments and related methods are also disclosed.

BRIEF DESCRIPTION OF THE DRAWINGS

Embodiments of the invention will be described with respect to the drawings in which like reference numerals denote like elements, and in which.

DESCRIPTION

The present innovation relates to a family of sign holder assemblies of varying dimensions all having at least one commonly sized track or channel on a rear side thereof for receiving various hardware pieces, e.g., connectors or mounting members, for mounting signs in a retail environment. By standardizing the tracks and configuring the different sizes of signs for use with similarly sized mounting members, the inventory of mounting members on hand to mount signs within the retail environment can be greatly decreased.

The mounting members of the innovation are configured to facilitate coupling the sign to hang from various support structures such as one or more of a front of a shelf, a pegboard, a railing or substantially horizontal support, and/or to be mounted on top of a shelf or support rail/structure. Many of the mounting members are configured to facilitate coupling with multiple types of supports, which further decreases the number of mounting member types required. In one embodiment, one mounting member may be selectively coupled with another mounting member, wherein one mounting member is coupled directly to the sign holder assembly and the other is coupled directly to the support structure to hang or mount a corresponding sign holder assembly on or from a support structure. In one example, sign holder assemblies with a number of tracks can receive the mounting members in any one of the plurality of tracks to adjust the height of the sign relative to the support structure receiving the mounting member opposite the sign.

Figure 1:
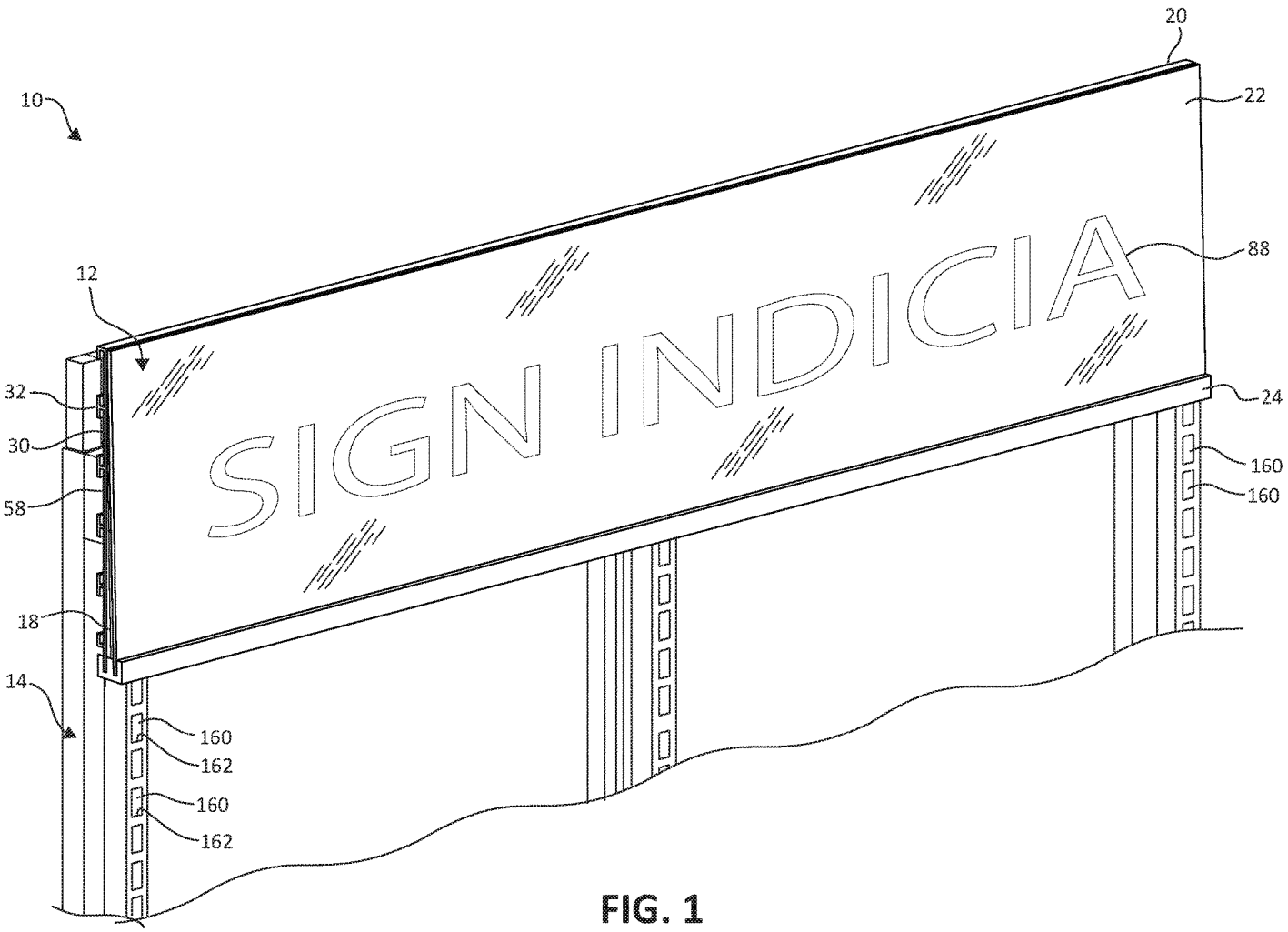
FIG. 1 is a front perspective view illustration of a sign holder assembly on a freestanding display fixture, according to one embodiment of the present invention.
Figure 2:
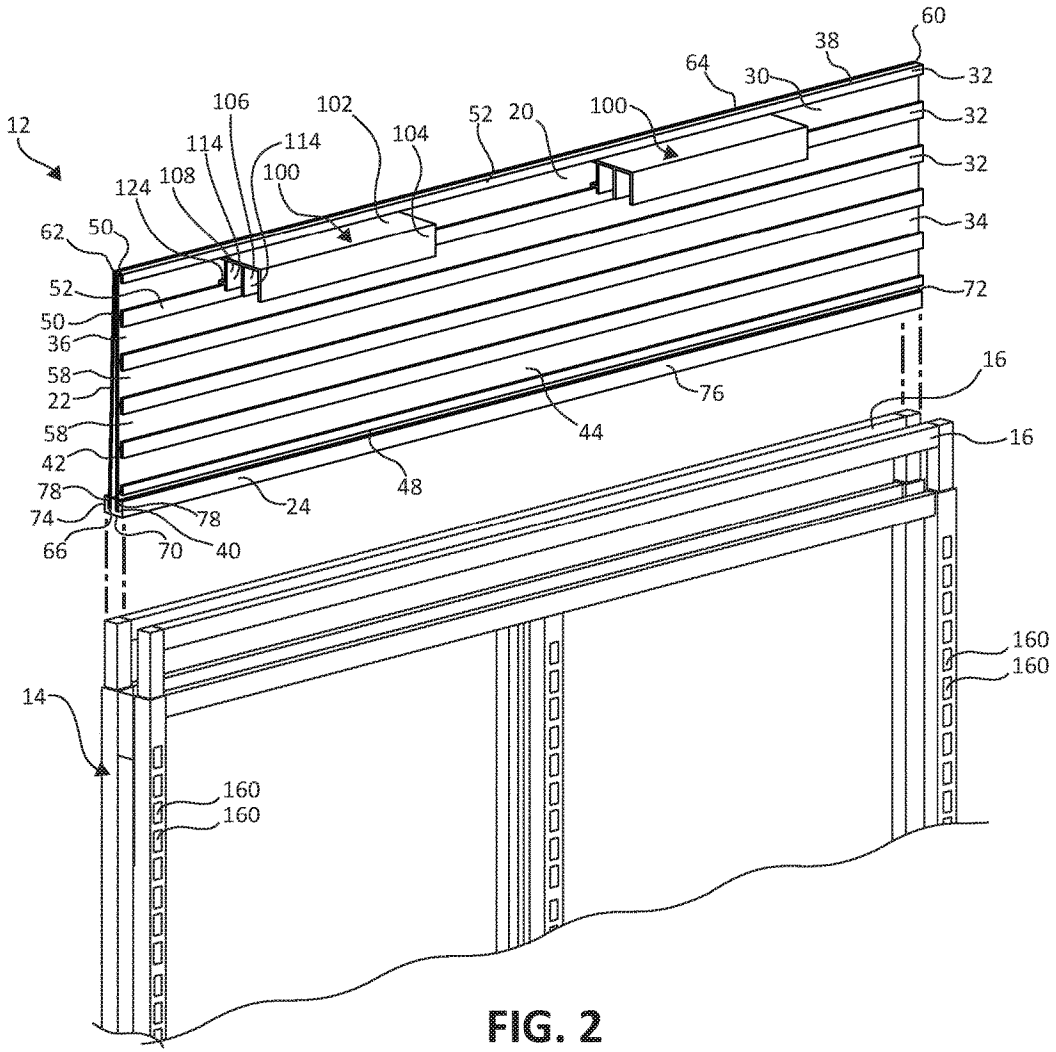
FIG. 2 is an exploded, rear perspective view illustration of the sign holder assembly, mounting members, and display fixture of FIG. 1, according to one embodiment of the present invention.

Turning to the Figures, FIGS. 1 and 2 each illustrate a retail product display 10 including a sign holder assembly 12 coupled to a display fixture 14 and selectively holding a sign 18. More particularly, display fixture 14 includes a support cross bar 16, and sign holder assembly 12 coupled to support cross bar 16 with a mounting member 100. Sign holder assembly 12 is configured to allow for mounting to various display fixtures, such as display fixture 14, by changing a position of mounting member 100 relative to sign holder assembly 12 and/or by changing mounting member 100 with different mounting members, such as mounting members 130, 170, 210, 240, 290, 320, 350, 380, and 430, as will be further described below. While display fixture 14 with support cross bar 16 is shown in one configuration for illustrative purposes, use of many other embodiments of display fixtures is contemplated.

Sign holder assembly 12 is further illustrated in FIGS. 3-6 and includes a backer or support member 20, a cover member 22, and a base member 24. Each of support member 20 and cover member 22 are received by and extend upwardly from base member 24. Sign 18 is a substantially planar media sheet and is selectively received above base member 24. Sign 18 is held in place between support member 20 and cover member 22. In one embodiment, cover member 22 is substantially transparent such that sign 18 is readily viewable through cover member 22.

In one embodiment, support member 20 includes a substantially planar panel 30 and a plurality of rails 32. Support member 20 is substantially rectangular or otherwise suitably shaped to extend longitudinally between a first end 34 and a second end 36. Accordingly, support member 20 defines a top edge 38 and a bottom edge 40 opposite top edge 38 each extending between first end 24 and second end 36, for example, substantially parallel to one another. Support member 20 is substantially planar, in one instance, forming a first or front surface 42 and a second or rear surface 44 opposite front surface 42. In one embodiment, a bottom portion 48 of substantially planar panel 30 extends below a bottommost one of the plurality of rails 32.

Each of the plurality of rails 32 extends rearwardly from rear surface 44 of support member 20. More particularly, each rail 32 extends longitudinally between and to each of first end 34 and second end 36, in one example, and each rail 32 is vertically spaced from other ones of the plurality of rails 32. In one embodiment, each of the plurality of rails 32 includes a spacing protrusion 50 extending forwardly from front surface 42 of support panel 20, for instance, substantially perpendicularly relative to front surface 42. Each of the plurality of rails 32 further includes a vertically extending or cross member 52 extending across an end of spacing protrusion 50 opposite front surface 42. For example, each cross member 52 extends substantially parallel to front surface 42 and one or both of upwardly and downwardly therefrom.

For example, ones of the plurality of rails 32 between the topmost and bottommost ones of the plurality of rails 32 includes a cross member 52 having a first segment 54 extending upwardly beyond spacing protrusion 50 and a second segment 56 extending downwardly beyond spacing protrusion 50. A topmost one of the plurality of rails 32 is positioned adjacent to and extends substantially conterminously with top edge 38 of substantially planar panel 30. The topmost one of the plurality of rails 32 only includes second segment 56 extending downwardly from spacing protrusion with substantially no portion extending upwardly from spacing protrusion 50, in one example. A bottommost one of the plurality of rails 32 only includes first segment 54 extending upwardly from spacing protrusion with substantially no portion extending downwardly from the corresponding spacing protrusion 50, in one example.

Longitudinally extending channels 57 are defined adjacent spacing protrusion 50 between substantially planar panel 30 and cross member 52, and each of longitudinally extending channels 57 is open opposite spacing protrusion 50 such that pairs of longitudinally extending channels face toward one another. In one example, a pair of longitudinally extending channels 57 facing one another collectively define a reception track 58 for receiving a different mounting member, as will be further described below. Each reception track 58 has a substantially identical height, generally indicated as $D_1$ in FIG. 6, such that each reception track 58 can interchangeably receive mounting members having an appropriately sized flange or similar member. In one example, support member 20 is formed of stacked and glued plastic members, as a single extruded member, or as and injection-molded plastic or similar member. Use of other suitable members and/or materials to form support member 20 are also contemplated.

Cover member 22 is substantially rectangular in shape and sized a desired length and width for receiving sign 18, for example, printed sheet material, between cover member 22 and support member 20. More specifically, cover member 22 extends from a first end 60 to a second end 62 opposite first end 60 and from a top edge 64 to a bottom edge 66 opposite top edge 64. In one embodiment, support member 20 and cover member 22 have substantially identical length and width dimensions. Cover member 22 is substantially transparent, that is one of transparent and translucent, to allow sign 18 to be viewed through cover member 22. In one example, cover member 22 is formed from a suitable sheet or extruded polymer or other suitable material.

Figure 6:
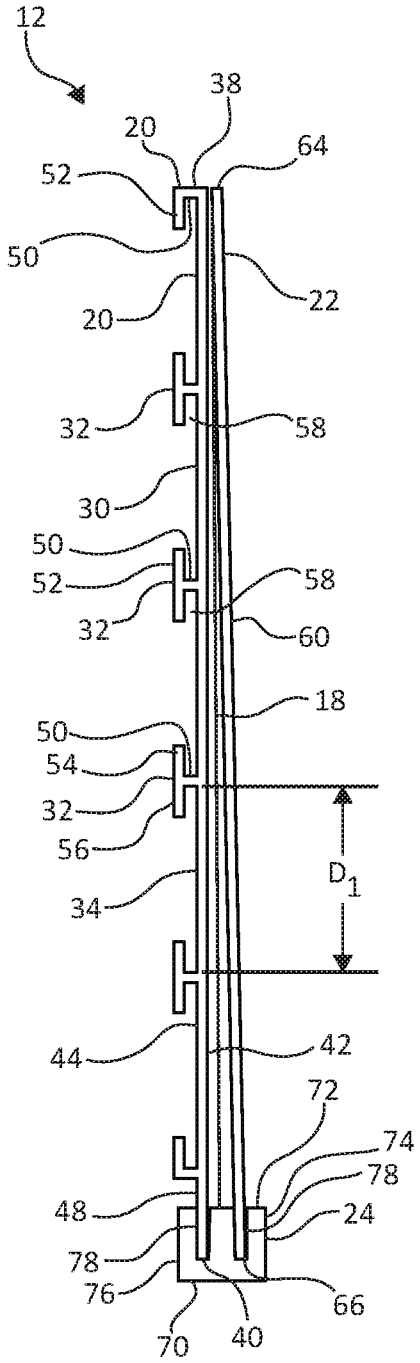
FIG. 6 is a left side view illustration of the sign holder assembly and the sign of FIG. 3, according to one embodiment of the present invention, wherein the right side view is a mirror image of the left side view.
Figure 7:
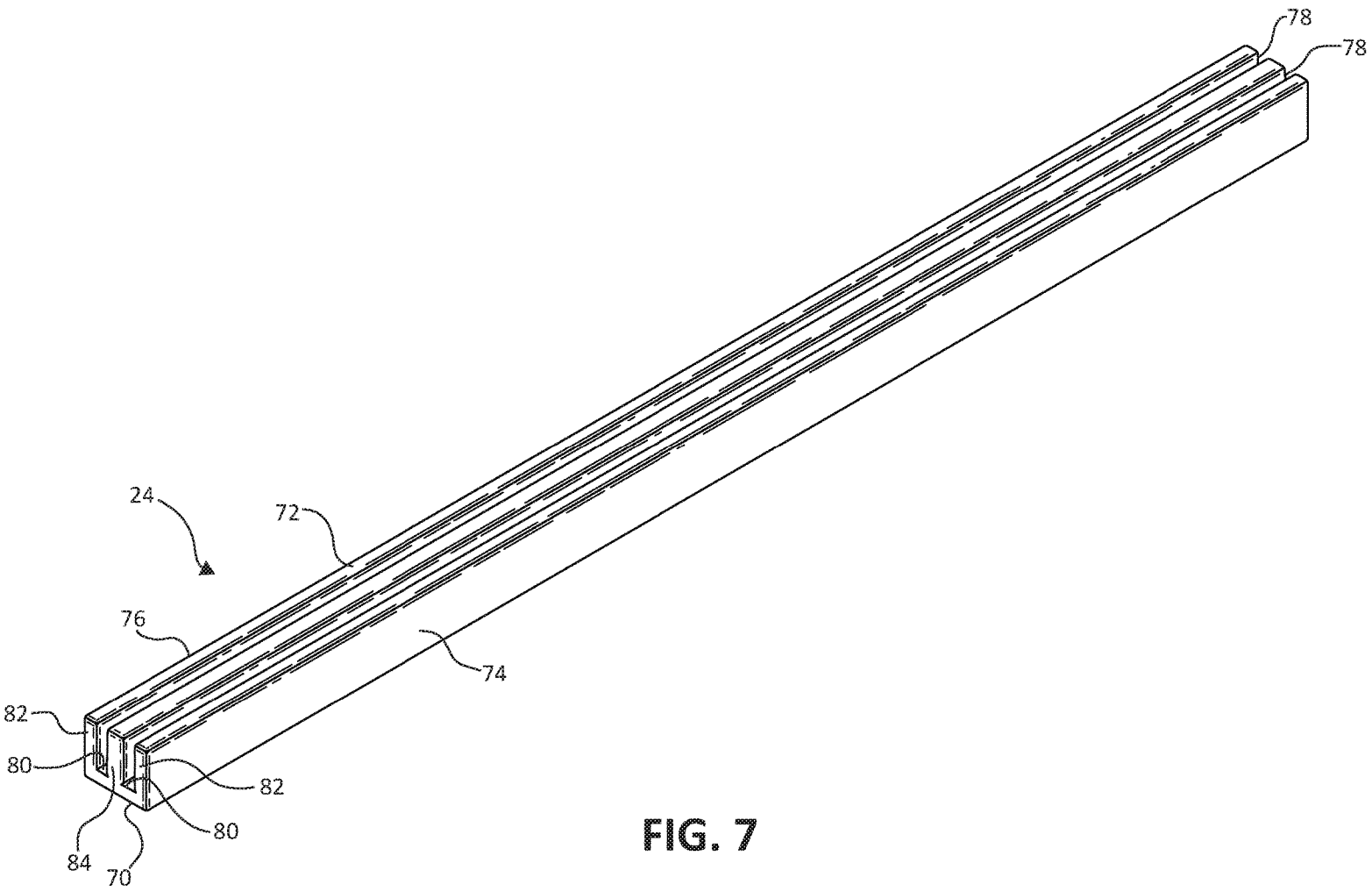
FIG. 7 is a front perspective illustration of a base member of the sign holder assembly of FIG. 3, according to one embodiment of the present invention.
Figure 8:
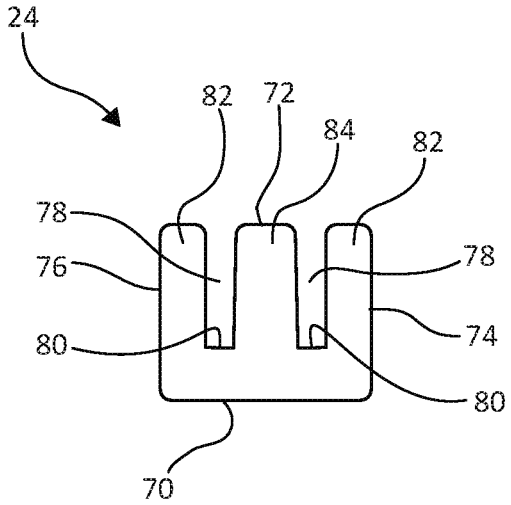
FIG. 8 is a right side view illustration of the base member of FIG. 7, according to one embodiment of the present invention.

Referring to FIGS. 7 and 8 in addition to FIGS. 1-6, base member 24 is formed from extruded or injection molded plastic or other suitable material and defines a bottom surface 70, a top surface 72 opposite bottom surface 70, a front surface 74, and a rear surface 76 opposite front surface 74 to form a generally rectangular or trapezoidal cross-sectional shape. Base member 24 includes two elongated slots 78 extending from top surface 72 toward bottom surface 70 with a front to back dimension substantially equal to a thickness of one of substantially planar panel 20 of support member 20 and cover member 22. Each of the two elongated slots 78 extends from end to end of base member 24 substantially parallel to one another. Each of the two elongated slots 78 defines a top facing edge or surface 80 extending substantially parallel to each of and positioned between top surface 72 and bottom surface 70. The two elongated slots 78 divide base member 24 into segments including outside segments 82 each on an outside of one of the two elongated slots 78 and an intermediate segment 84 between the two elongated slots 78. In one example, one or both of the two elongated slots 78 are angled slightly inwardly as it extends closer to top surface 72.

Figure 3:
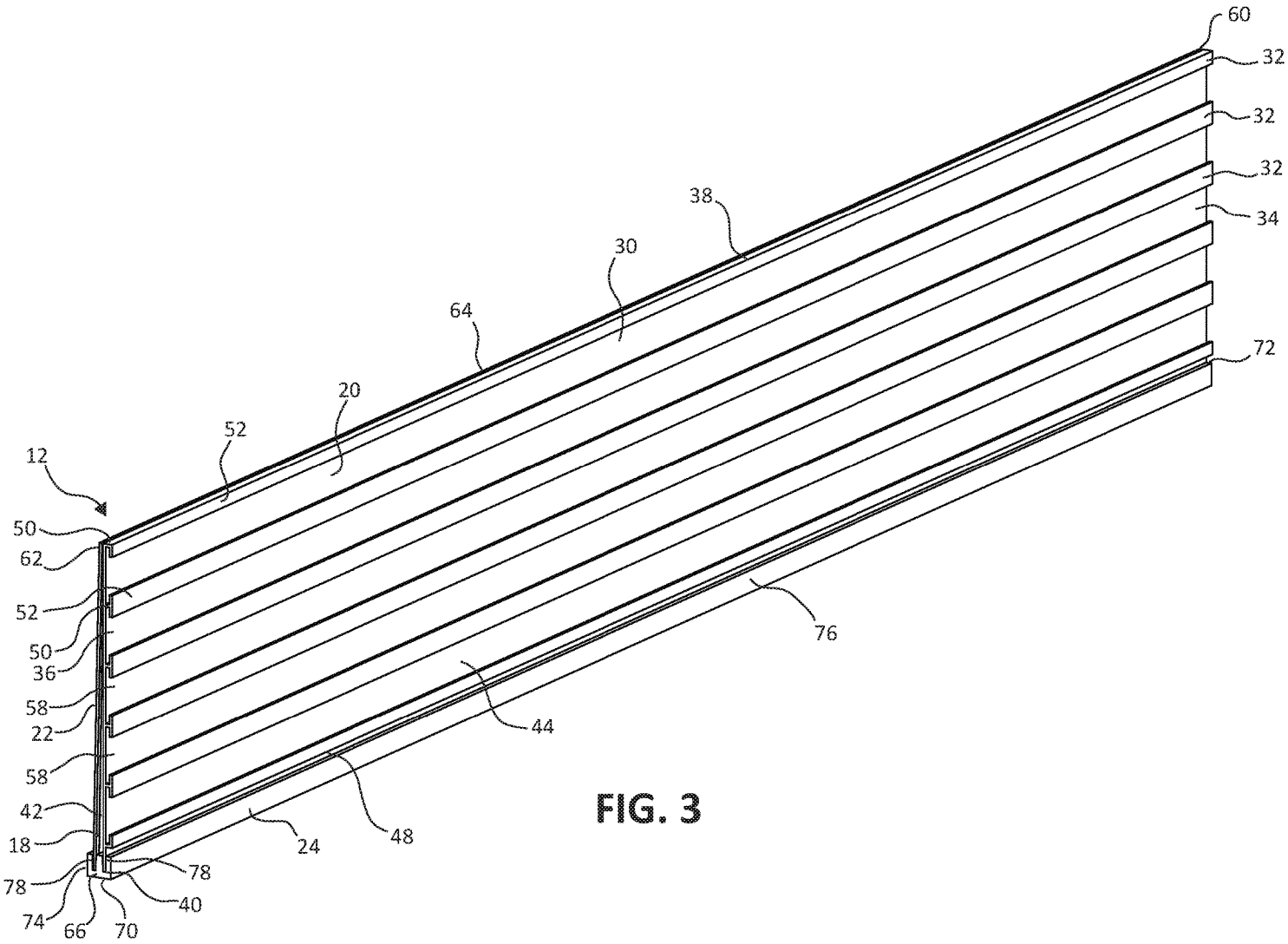
FIG. 3 is a rear perspective view illustration of the sign holder assembly of FIG. 1, according to one embodiment of the present invention.
Figure 4:
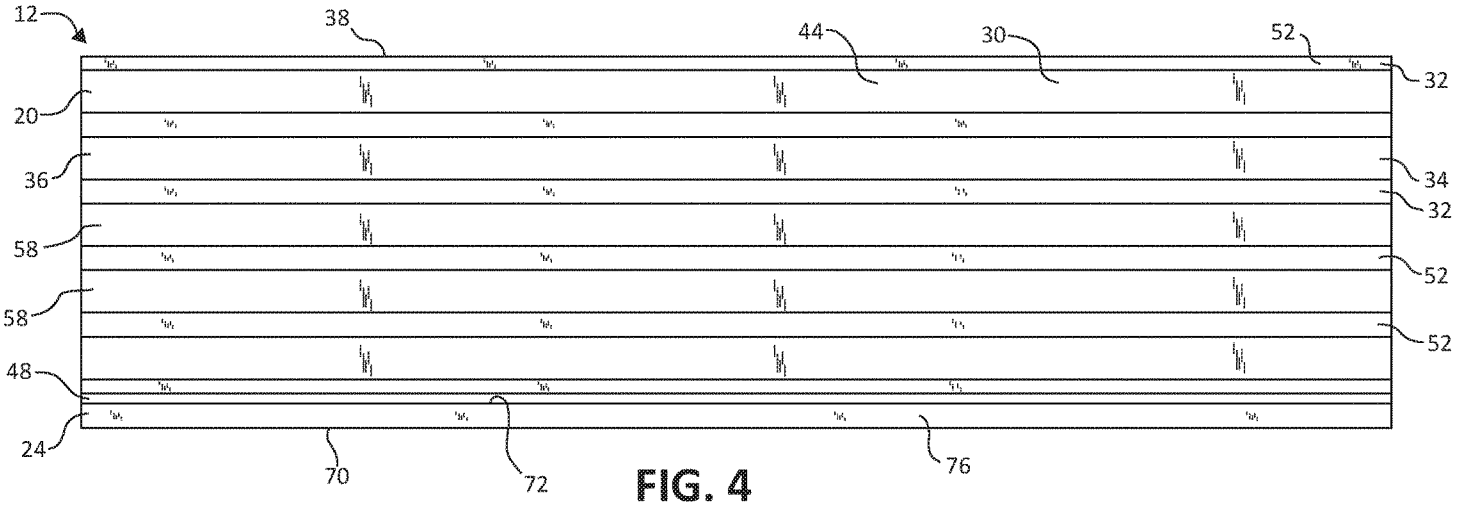
FIG. 4 is a rear view illustration of the sign holder assembly and the sign of FIG. 3, according to one embodiment of the present invention.
Figure 5:
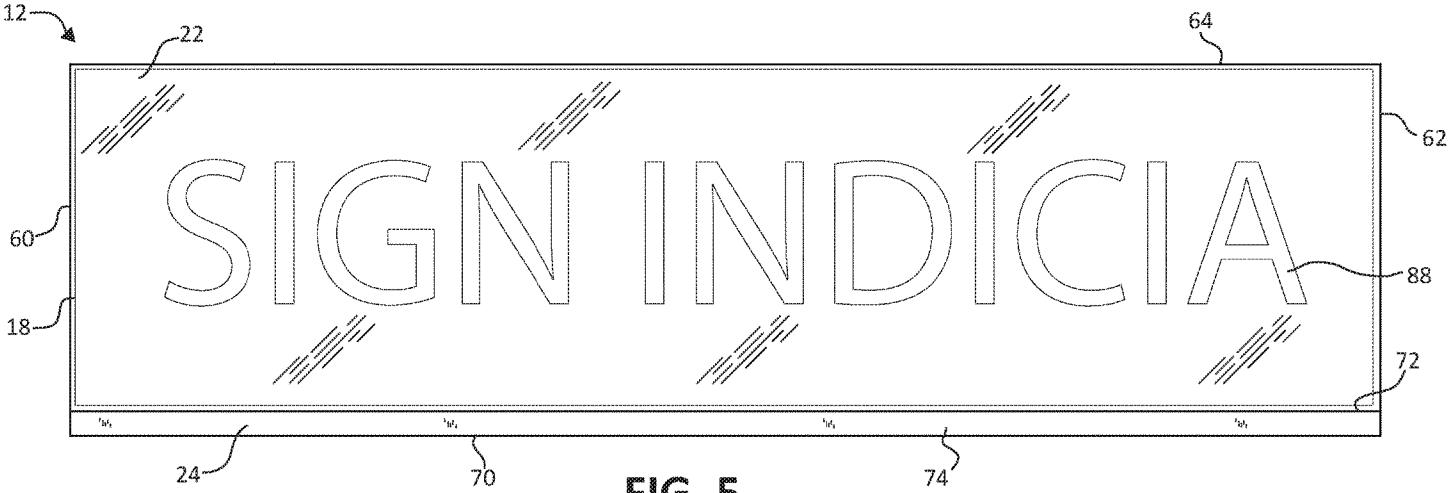
FIG. 5 is a front view illustration of the sign holder assembly and the sign of FIG. 3, according to one embodiment of the present invention.

Sign holder assembly 12 is constructed by placing bottom edge 40 of support member 20 into a first or rear one of the two elongated slots 78, for example, by sliding bottom edge 40 into a rear one of the two elongated slots 78. More particularly, in one instance, front surface 42 of substantially planar panel 30 is positioned to face toward the other one of the two elongated slots 78. A bottom edge 66 of cover member 22 is placed in the other, second, or front one of the two elongated slots 78. In one example, cover member 22 is angled from base member 24 of cover member 22 toward front surface 42 of substantially planar panel 30 of support member 20 such that sign holder assembly 12 is configured to maintain sign 18, e.g., a printed sheet material sign, between cover member 22 and front surface 42 of support member 20 as shown in FIGS. 1, 3, and 6, for example. Elongated slots 78 of base member 24 are sized to tightly and securely hold each of support member 20 and cover member 22 slid into place or otherwise positioned in elongated slots 78. In one example, support member 20 and/or cover member 22 is adhered, ultrasonically welded or otherwise secured in place within a corresponding one of elongated slots 78 of base member 24.

Figure 9:
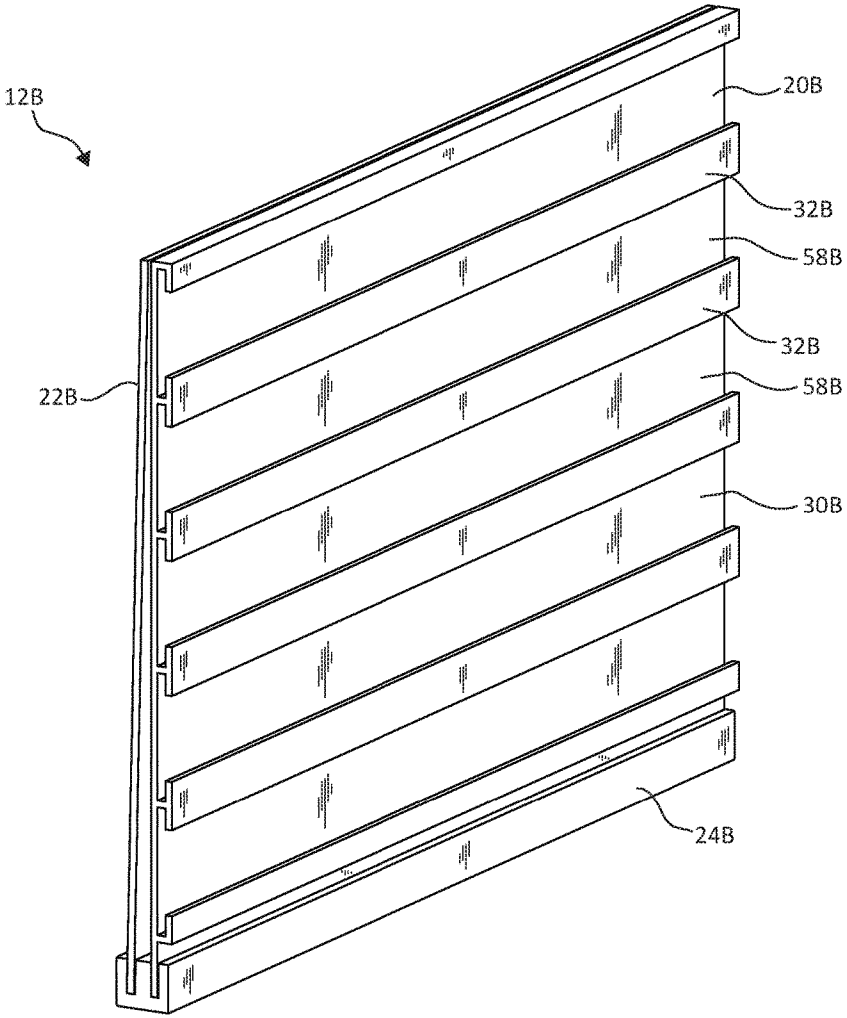
FIG. 9 is a rear perspective view illustration of a sign holder assembly, according to one embodiment of the present invention.
Figure 10:
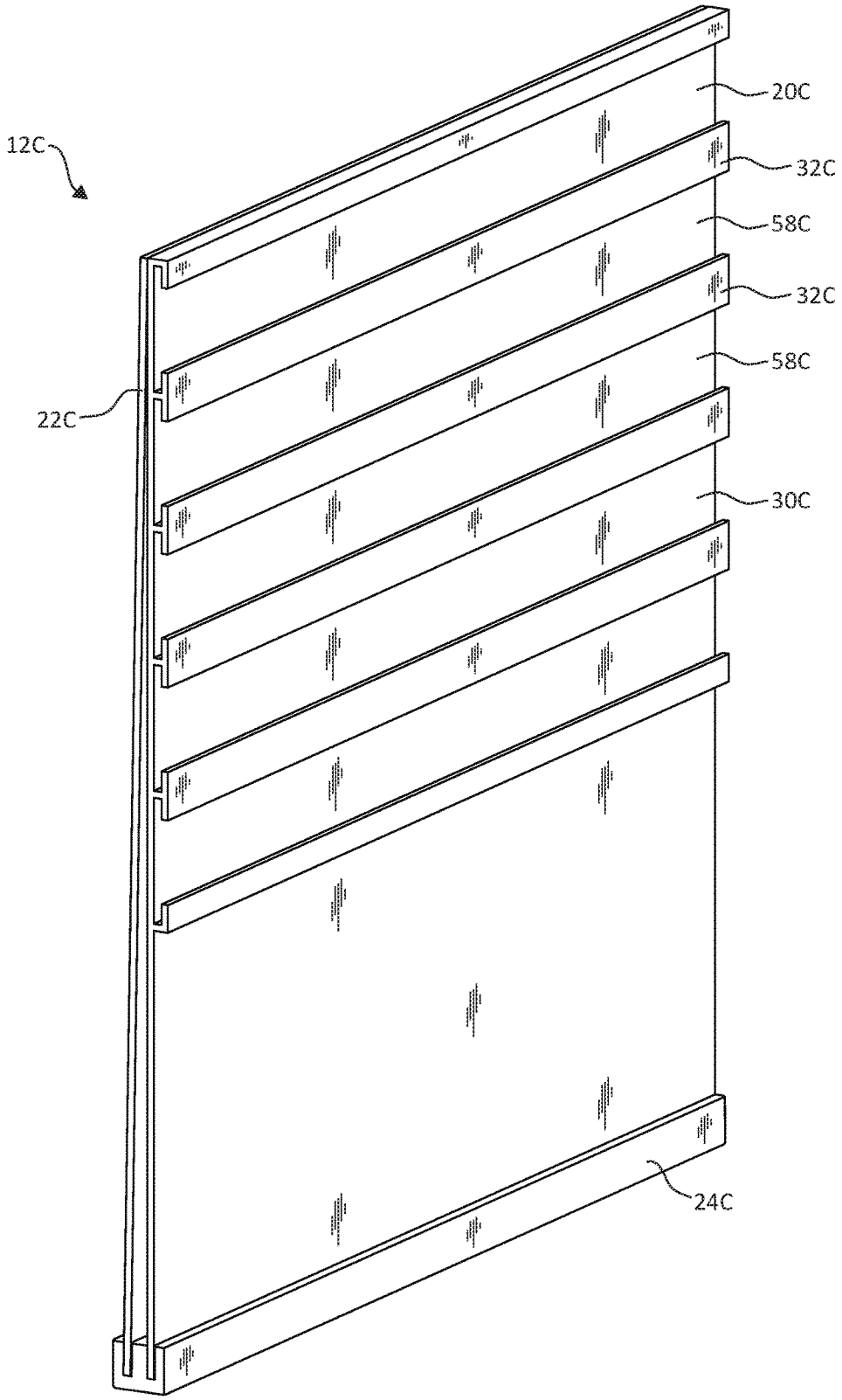
FIG. 10 is a rear perspective view illustration of a sign holder assembly, according to one embodiment of the present invention.
Figure 11:
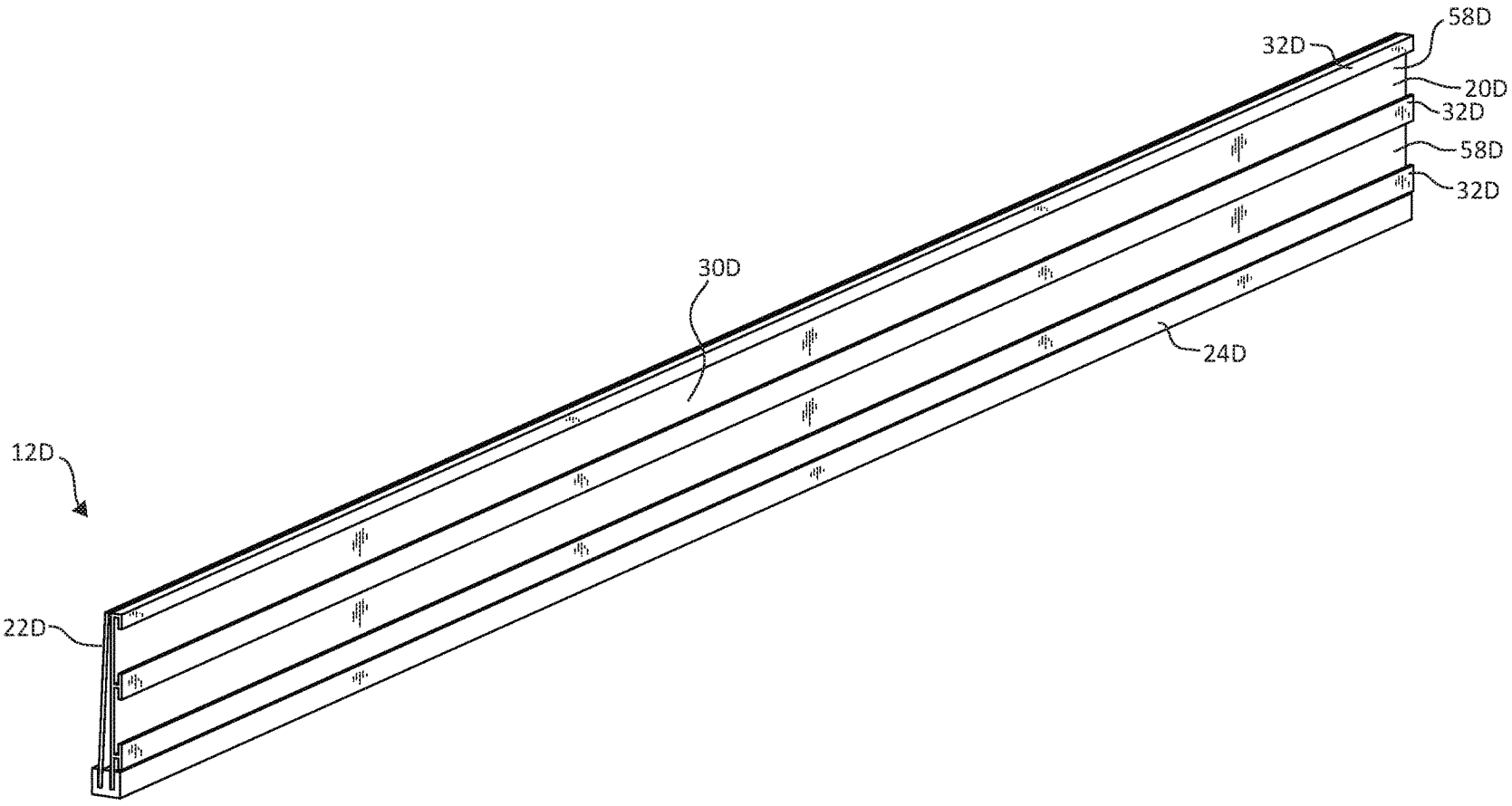
FIG. 11 is a rear perspective view illustration of a sign holder assembly, according to one embodiment of the present invention.

Sign 18 with indicia 88 to be displayed is received between support member 20 and cover member 22 with indicia 88 facing cover member 22 for display to consumers in, for example, a retail environment. As illustrated, for example in FIGS. 9-11, other example sign holder assemblies, such as sign holder assemblies 12B, 12C, and 12D, are contemplated. Each sign holder assembly 12B, 12C, and 12D includes a support member 20B, 20C, and 20D, respectively similar to support member 20 but with different heights, lengths, and numbers of rails, a cover member 22B, 22C, and 22D, respectively similar to cover member 22 but with different overall dimensions, and a base member 24B, 24C, and 24D. Each of base embers 24B, 24C, and 24D has a substantially identical cross section and differ substantially only in length in some instances to match lengths of corresponding support members 20B, 20C, and 20D and cover members 22B, 22C, and 22D, substantially identical to base member 24 other than varying lengths.

Each support member 20B, 20C, and 20D includes a corresponding substantially planar panel 30B, 30C, and 30D with an appropriate number of rails 32B, 32C, and 32D thereon depending upon an overall height of sign holder assembly 12B, 12C, and 12D. In one example, each of sign holder assemblies 12B, 12C, and 12D defines one or more reception tracks 58B, 58C, and 58D all having a substantially identical heights $D_1$ such that each of sigh holder assemblies 12, 12B, 12C, and 12D can be used with similar mounting members as will be described in additional detail below. It should be understood in reading this application, that while mounting members described below are specifically described for use with sign holder assembly 12, any of sign holder assembles 12B, 12C, and 12D could be interchanged with sign holder assembly 12.

Figure 12:
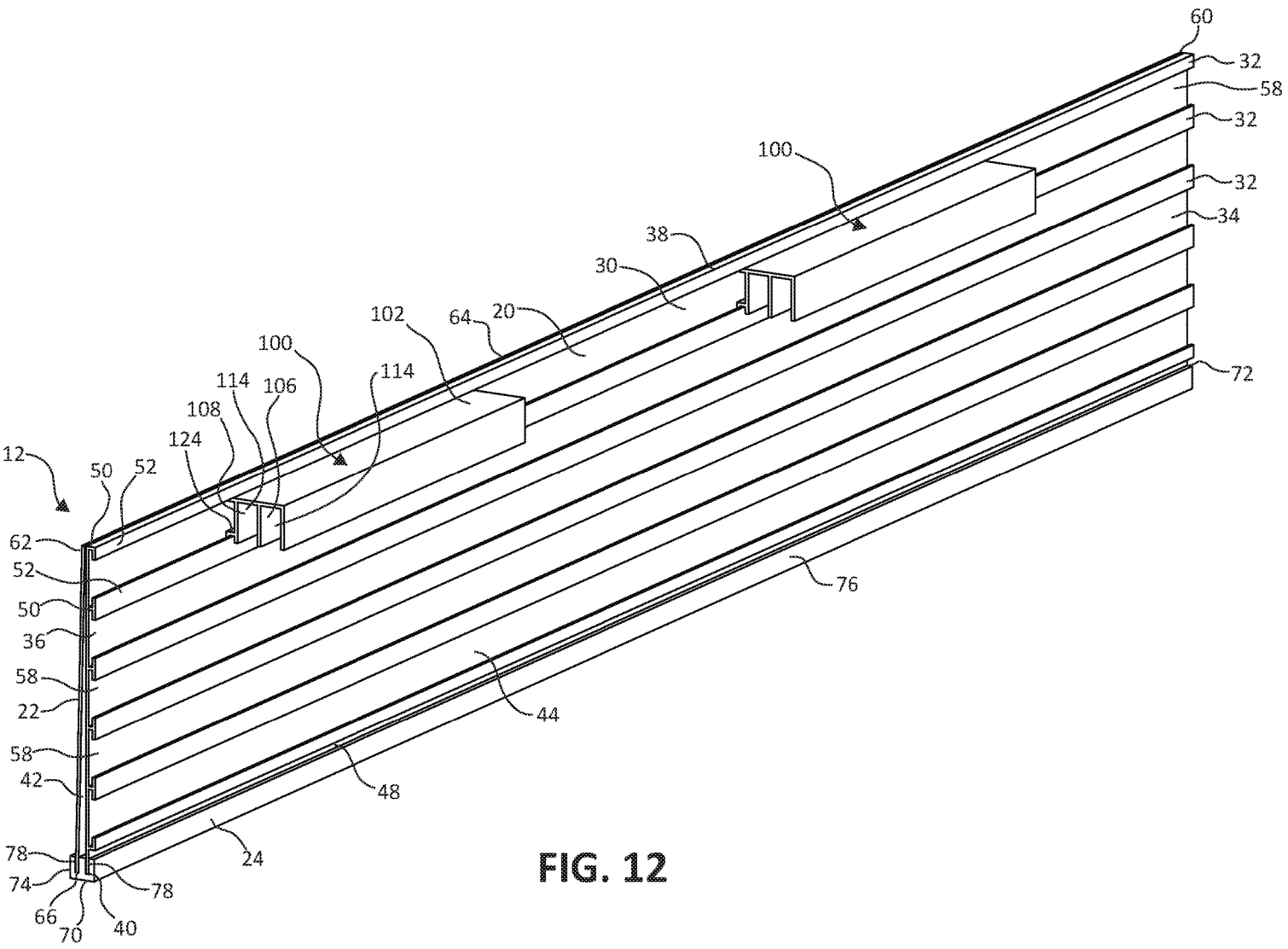
FIG. 12 is a rear perspective view illustration of a sign holder assembly of FIG. 1 and a mounting member, according to one embodiment of the present invention.
Figure 13:
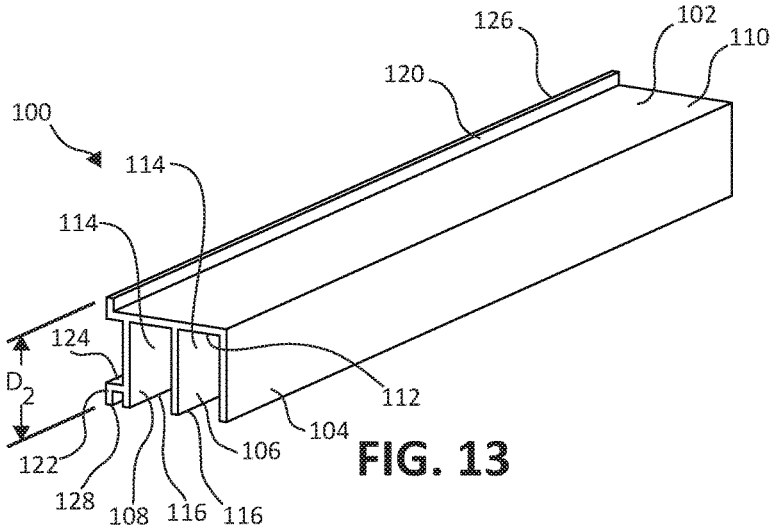
FIG. 13 is a rear perspective view illustration of the mounting member of FIG. 12, according to one embodiment of the present invention.
Figure 14:
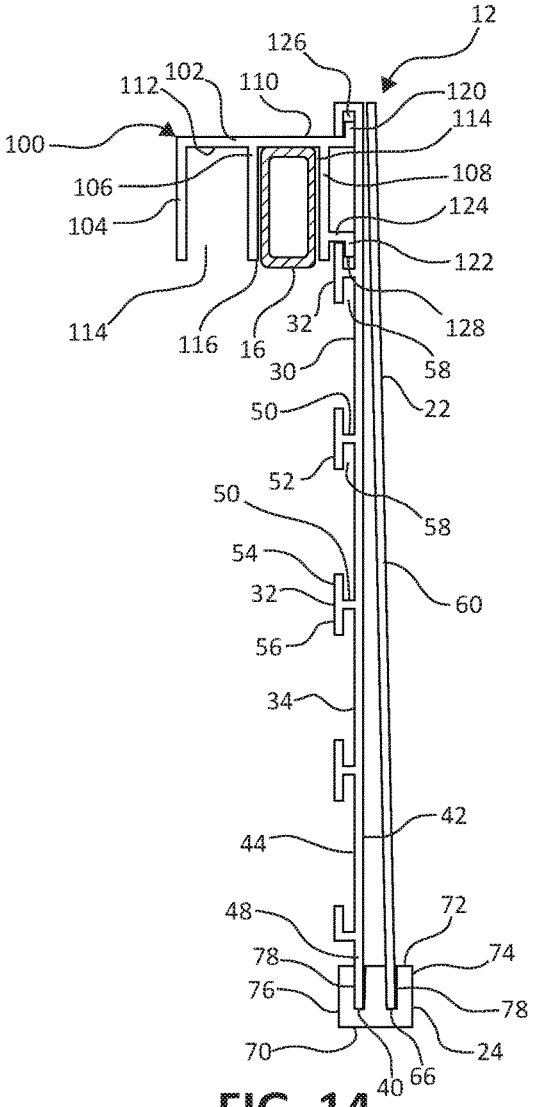
FIG. 14 is a left side view illustration of the sign holder assembly, the mounting member, and a support bar of FIG. 2, according to one embodiment of the present invention.

FIG. 12 illustrates sign holder assembly 12 with a pair of connection components or mounting members 100, e.g., first mounting members 100, slide into a top reception track 58 of support member 20. Additionally referring to FIGS. 13 and 14, each mounting member 100 includes a top panel 102, a rear panel 104, an intermediate panel 106, and a front panel 108. Top panel 102 is substantially planar and extends substantially horizontally defining a broad top surface 110 and a broad bottom surface 112. Each of rear panel 104, intermediate panel 106, and front panel 108 are substantially planar and extend downwardly from bottom surface 112 of top panel 102. In one example, rear panel 104, intermediate panel 106, and front panel 108 are substantially similar in size and shape and extend substantially parallel to one another. Rear panel 104 extends from a rear edge of top panel 102, intermediate panel 106 is forwardly spaced from rear panel 104, and front panel 108 is forwardly spaced from intermediate panel 106. Accordingly, reception grooves or channels 114 are each defined between either rear panel 104 and intermediate panel 106 or intermediate panel 106 and front panel 108, and each reception channel 114 includes openings 116 opposite top panel 102 and facing downwardly. In one example each of the reception channels 114 are substantially identical in size and shape.

Mounting member 100 further includes a top flange 120 and a bottom flange 122 opposite top flange 120 collectively defining a coupling flange or backer interface panel. Top flange 120 extends from a front edge of top panel 102, for example, substantially perpendicularly and upwardly relative to top panel 102. Bottom flange 122 is formed in a common plane with top flange 120, which extends downwardly away from top flange 120. In one example, a bottom flange offset 124 extends forwardly from front panel 108 and bottom flange 122 depends therefrom opposite front panel 108. Bottom flange offset 124 spaces bottom flange 122 from front panel 108. In one instance, top flange 120 and bottom flange 122 extend parallel to rear panel 104, intermediate panel 106, and front panel 108. Top flange 120 and bottom flange 122 extend away from each other to define a free top edge 126 and a free bottom edge 128, respectively.

A distance $D_2$ is defined between free top edge 126 and free bottom edge 128 that is just slightly less than distance $D_1$ of reception tracks 58 of sign holder assembly 12. Accordingly, mounting member 100 is readily slid into a selected channel 58 of sign holder assembly 12 such that each of top flange 120 and bottom flange 122 is retained within a different one of the elongated channels 57 defining a reception channel 58. Mounting member 100, thereby, extends rearwardly from sign holder assembly such that channels 114 are open at a bottommost portion thereof. In one example, depending upon the length of sign holder assembly 12, two or more mounting members 100 are placed in a single channel 58 thereof longitudinally spaced from one another. Mounting members 100 facilitate toolless coupling or mounting of sign holder assembly 12 to display fixture 14. More particularly, each channel 114 is sized and shaped to receive support cross bar 16 of display fixture 14, for example, as illustrated with reference to FIGS. 1, 2, and 14. The particular reception channel 58 that receives mounting members 100 is selected to vary a height that sign holder assembly 12 extends above support cross bar 16. The one of the channels 114 is selected to receive support cross bar 16 based on how far one desires sign holder assembly 12 to extend in front of or behind support cross bar 16. When support cross bar 16 is received in one of channels 114, sign holder assembly 12 is maintained above and on one side of display fixture 14. In one example, display fixture 14 supports hardline or softline merchandise below sigh holder assembly 12 related to indicia 88 on sign 18 maintained by sign holder assembly 12.

Figure 15:
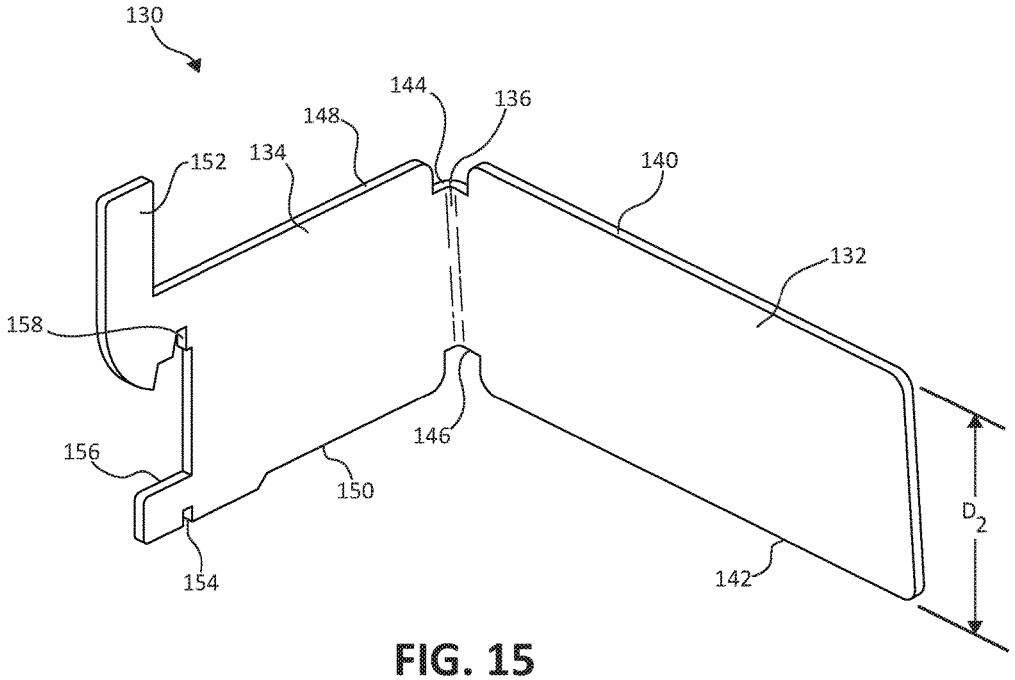
FIG. 15 is a rear perspective view illustration of a mounting member, according to one embodiment of the present invention.
Figure 16:
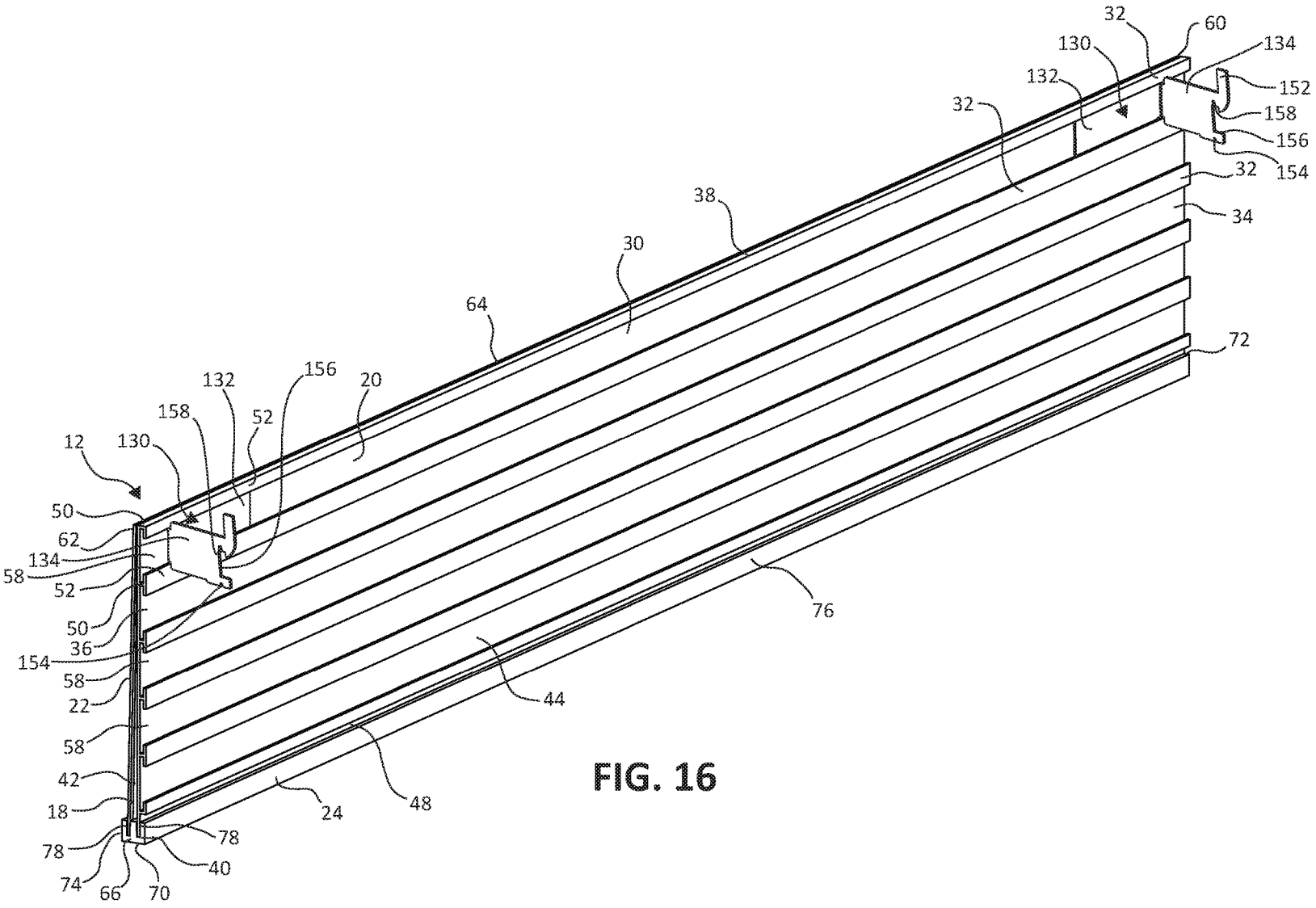
FIG. 16 is a rear perspective view illustration of the sign holder assembly of FIG. 3 and mounting members of FIG. 15, accordingly to one embodiment of the present invention.

FIG. 15 illustrates another (e.g., a second) connection component or mounting member 130 for use with sign holder assembly 12 (FIG. 16). In one embodiment, mounting member 130 is bent or otherwise formed from a sheet of metal, such as aluminum or other suitable metal and defines a front panel 132 (e.g., a backer interface panel or connecting flange), a side panel 134 extending substantially perpendicularly relative to and from one end of front panel 132, and a corner portion 136 extending between and coupling front panel 132 to side panel 134. Each of front panel 132 and side panel 134 is substantially planar. Front panel 132 defines a top edge 140 opposite a bottom edge 142. Likewise, side panel 134 defines a top edge 148 opposite a bottom edge 150, and corner portion 136 defines a top edge 144 opposite a bottom edge 146. While top edges 140 and 148 are positioned in a common horizontal plane, in one embodiment, top edge 144 is inset toward bottom edge 146 to provide clearance for plate 132 interaction with reception tracks 58 of sign holder assembly 12 as shown, for example, in FIG. 16. Similarly, bottom edge 146 is upwardly inset from bottom edges 142 and 150 to provide similar clearance as inset top edge 144.

A distance $D_2$ is defined between top edge 140 and bottom edge 142 of front panel 132 such that front panel 132 is sized to be received and selectively maintained in reception tracks 58 of sign holder assembly 12 as illustrated in FIG. 16. Each side panel 134 additionally defines a top protrusion 152, a bottom edge notch 154, a rear cutout 156, and/or an internal notch 158 according to one embodiment of the invention in which mounting member 130 is configured to interact with a vertical support having a substantially vertical linear array of rectangular slots 160 (FIGS. 1 and 2) extending along a front face thereof. More specifically, top protrusion 152 extends upwardly beyond top edge 148 of side panel 132 from a rear edge 164 of side panel 132. Rear cutout 156 extends forwardly from rear edge 164 and defines an internal notch 158 extending upwardly from a remainder of rear cutout 156 to be more forwardly positioned than a forward edge of top protrusion 152. Bottom edge notch 154 is formed in a vertical line with internal notch 158.

During installation, top protrusion 152 is moved through and upward into a fixture via one of rectangular slots 160 and is then rearwardly and downwardly dropped or rotated such that internal notch 158 receives a bottom edge 162 (FIGS. 1 and 2) of one of elongated slots 160 and bottom edge notch 154 receives a bottom edge 162 (FIGS. 1 and 2) of a lower and adjacent elongated slot 160 such that mounting member 130 is securely held in place by display fixture 14 until purposefully moved upwardly and rotated to move top protrusion 152 out of display fixture 14 via the one of elongated slots 160. In one embodiment, mounting member 130 is provided in a right side orientation or a left side orientation, and one mounting member 130 of each orientation is positioned in a selected reception track 58 of sign holder assembly 12. Mounting members 130 are coupled with a vertical support of display fixture 14 such that sign holder assembly 12 is suspended between the two mounting members 130. Other configurations and uses are also contemplated.

Figure 17:
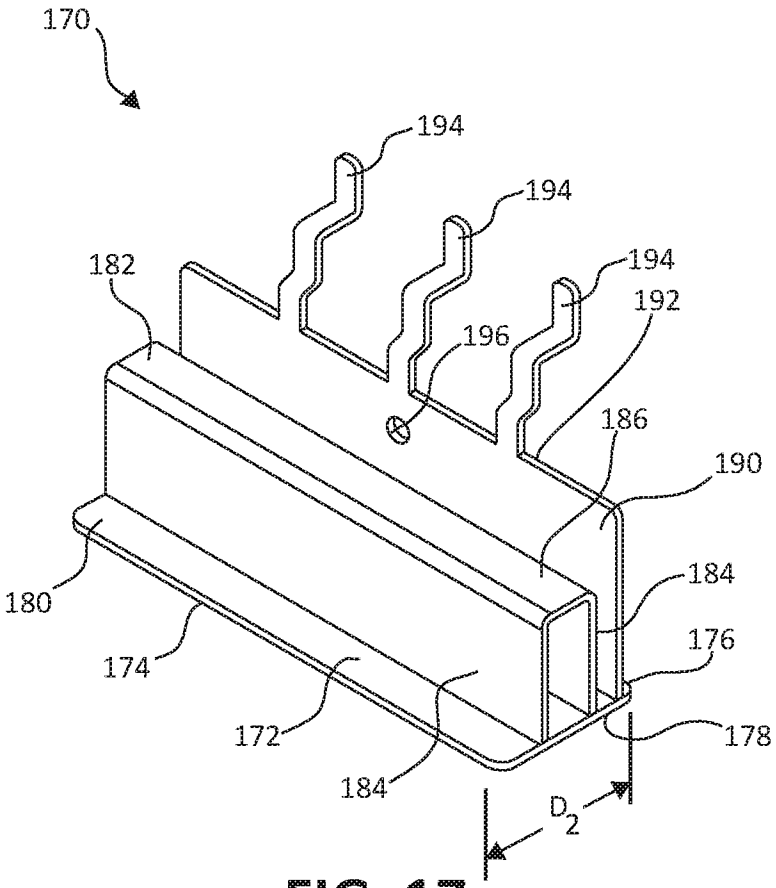
FIG. 17 is a front perspective view illustration of a mounting member, according to one embodiment of the present invention.

Another, e.g., a third, connection component or mounting member 170 is illustrated in FIG. 17. Mounting member 170 includes a first flange or plate 172 extending between a first edge 174, e.g., a front edge, and a second edge 176, e.g., a rear edge. First plate 172 defines a first primary surface 178, which is bottom facing in FIG. 17, and a second primary surface 180, which is top facing in FIG. 17. In one example, distance $D_2$ is defined between first edge 174 and second edge 176 such that first plate 172 is sized and shaped to be selectively received by one of reception tracks 58 of sign holder assembly 12, shown in FIG. 2, when desired.

Mounting member 170 includes a U-shaped protrusion 182 extending from first primary surface 178 of first plate 172. U-shaped protrusion 182 defines two sidewalls 184 substantially parallel with one another and a cap wall 186 extending from and between the two sidewalls 184 opposite first primary surface 178. In one example, U-shaped protrusion 182 is sized with a substantially identical overall cross-section or substantially identical outer depth defined between outside surfaces of the two sidewalls 184 as compared to support cross bar 16 of display fixture 14 (FIG. 2).

Figure 18:
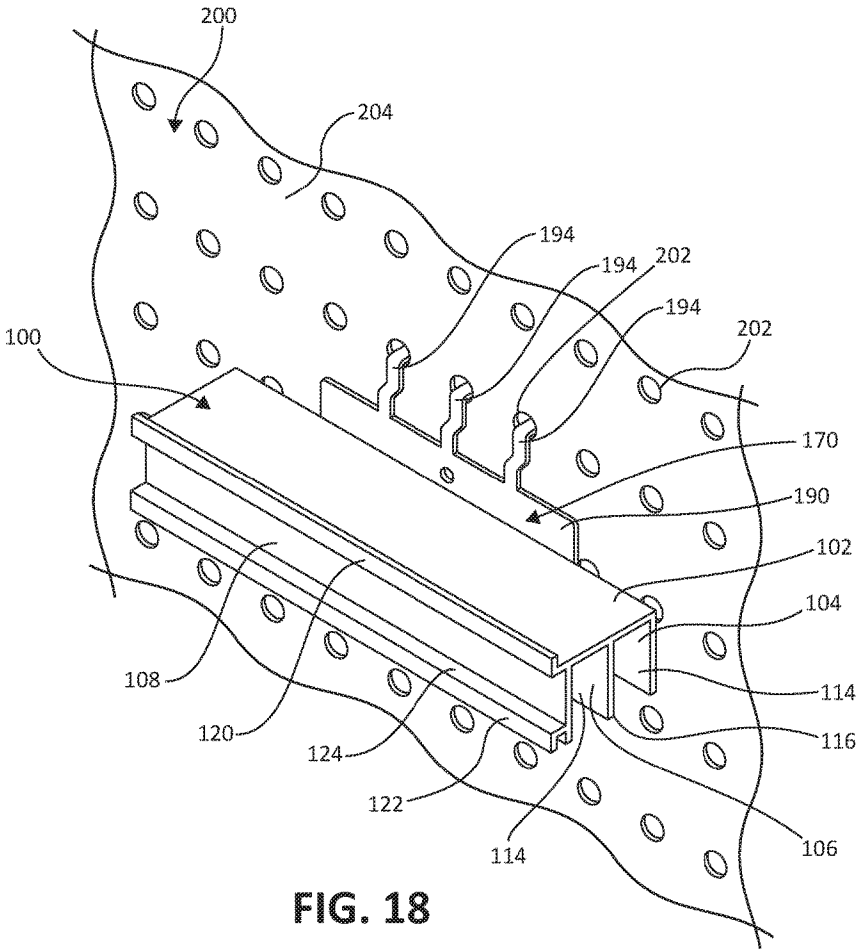
FIG. 18 is a front perspective view illustration of the mounting member of FIG. 17 hanging from a fixture support panel and coupled with the mounting member of FIG. 13, according to one embodiment of the present invention.
Figure 20:
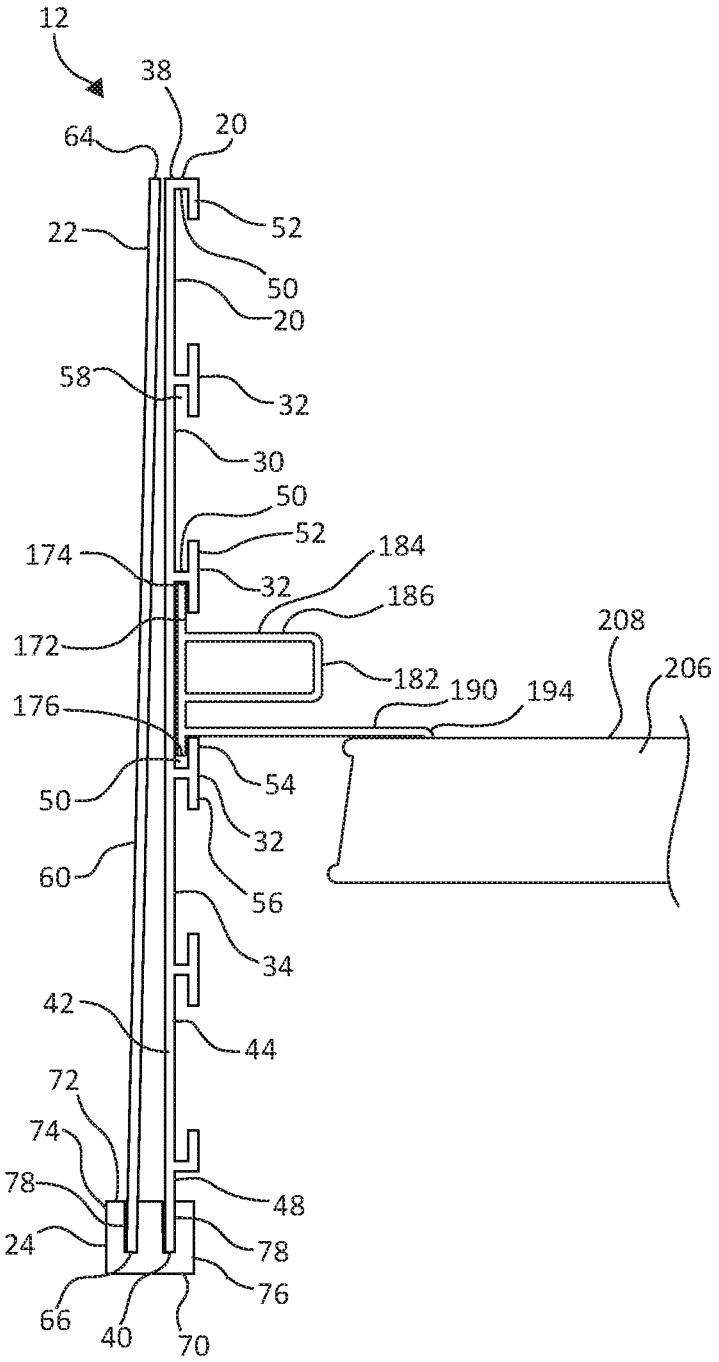
FIG. 20 is a right side view illustration of the mounting member of FIG. 17, the sign holder assembly of FIG. 3, and a display shelf, according to one embodiment of the present invention.

An extension plate 190 is substantially planar and extends from second primary surface 180 of first plate 172 near second edge 176 away from first primary surface 178 and with an orientation substantially perpendicular to first plate 172. Extension plate 190 extends away from first plate 172 to a free edge 192 opposite first plate 172. Free edge 192 is positioned further away from first plate 172 than cap wall 186. Two or more, for example, three, stepped hooks or stepped pegs 194 extend from free edge 192 further away from each of first plate 172 and first edge 174. Each of stepped pegs 194 is sized and spaced from other stepped pegs 194 such that stepped pegs 194 are configured for selective reception in adjacent apertures 202 defined by fixture support panel or pegboard panel 200 as illustrated in FIG. 18 or in similar apertures (not shown) formed along a front edge of a display shelf 206 (FIG. 20). In one example, an additional securement aperture 196 is formed through extension plate 190 to provide an avenue for receiving a fastener (not shown) to further couple mounting member 170 to pegboard panel 200 or display shelf 206 as will be apparent to those of skill in the art upon reading the currently application.

Figure 19:
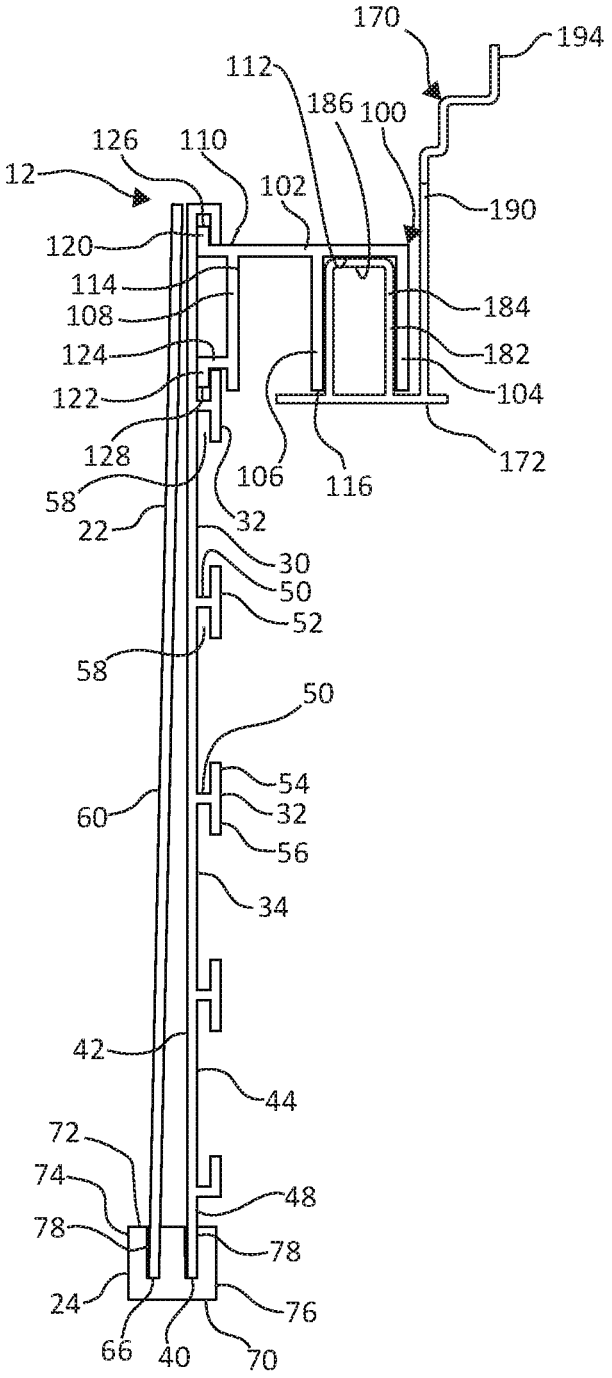
FIG. 19 is a right side view illustration of the mounting members of FIG. 18 and the sign holder assembly of FIG. 3, according to one embodiment of the present invention.

Mounting member 170 is configured for use in each of two configurations or orientations in a retail store. A first one of the configurations is illustrated in FIGS. 18 and 19 in which mounting member 170 is hung from pegboard panel 200, e.g., a substantially vertical panel with a two-dimensional array of apertures 202. More particularly, mounting member 170 is manipulated to tilt stepped pegs 194 and to move each one through linearly aligned ones of apertures 202. Upon insertion of stepped pegs 194 in aperture 202, mounting member 170 is tilted back or downwardly about apertures 202 such that each stepped peg 194 interfaces with internal surfaces (not shown) of pegboard panel 200, and second edge 176 of mounting member 170 contacts outer surface 204 of pegboard panel 200. In this hanging position or configuration, mounting member 170 is orientated such that each of extensions plate 190 and sidewalls 184 extends substantially vertically and first plate 172 extends substantially horizontally, in one embodiment.

Mounting member 100 or similar member is placed on and used in tandem with mounting member 170 to present a substantially or at least somewhat vertical flange for receiving sign holder assembly 12. For example, mounting member 100 is positioned such that U-shaped protrusion 182, which, in one embodiment, is sized substantially similar to support cross bar 16 (FIGS. 1 and 2) is snugly received within one of channels 114 (FIGS. 2 and 13), such as a rearmost one of channels 114. When received within one of channels 114 cap wall 186 interfaces with an underside of top panel 102 of mounting member 100. So positioned, top flange 120 and bottom flange 122 of mounting member 100 are positioned forwardly of pegboard panel 200 such that sign holder assembly 12 is installed on mounting member 100 to hang forwardly spaced from pegboard 200, for example, as apparent from collective viewing of FIGS. 18 and 19.

A second configuration for use of mounting member 170 is illustrated in FIG. 20. In this configuration, mounting member 170 is used in an orientation rotated clockwise about 90 degrees from the use configuration shown in FIGS. 17-19. Stepped pegs 194 are thread through a linear array of apertures (not shown) parallel to front edge of a retail display shelf 206 such that mounting member 170 interacts with top panel 208 of retail display shelf 206 in a similar, bur rotated, manner that interacts with pegboard panel 200 in FIG. 18. Accordingly, extension member 190 extends along and beyond a front edge of top panel 208 in a substantially horizontal orientation, thereby, positioning first plate 172 in a substantially vertical orientation to receive sign holder assembly 12 via reception channels 58 (e.g., FIGS. 2-4 and 6) as illustrated in FIG. 20. Notably, in each configuration of mounting member 170 use shown in FIGS. 18-20, sign holder assembly 12 is hung in a substantially vertical positioned via either direct (FIG. 20) or indirect (FIGS. 18 and 19) contact between mounting member 170 and sign holder assembly 12. By being configured for use in two different orientations for different retail display fixtures, use of mounting member 170 reduces the number of mounting members that need be maintained in a retail store inventory for use.

Figure 21:
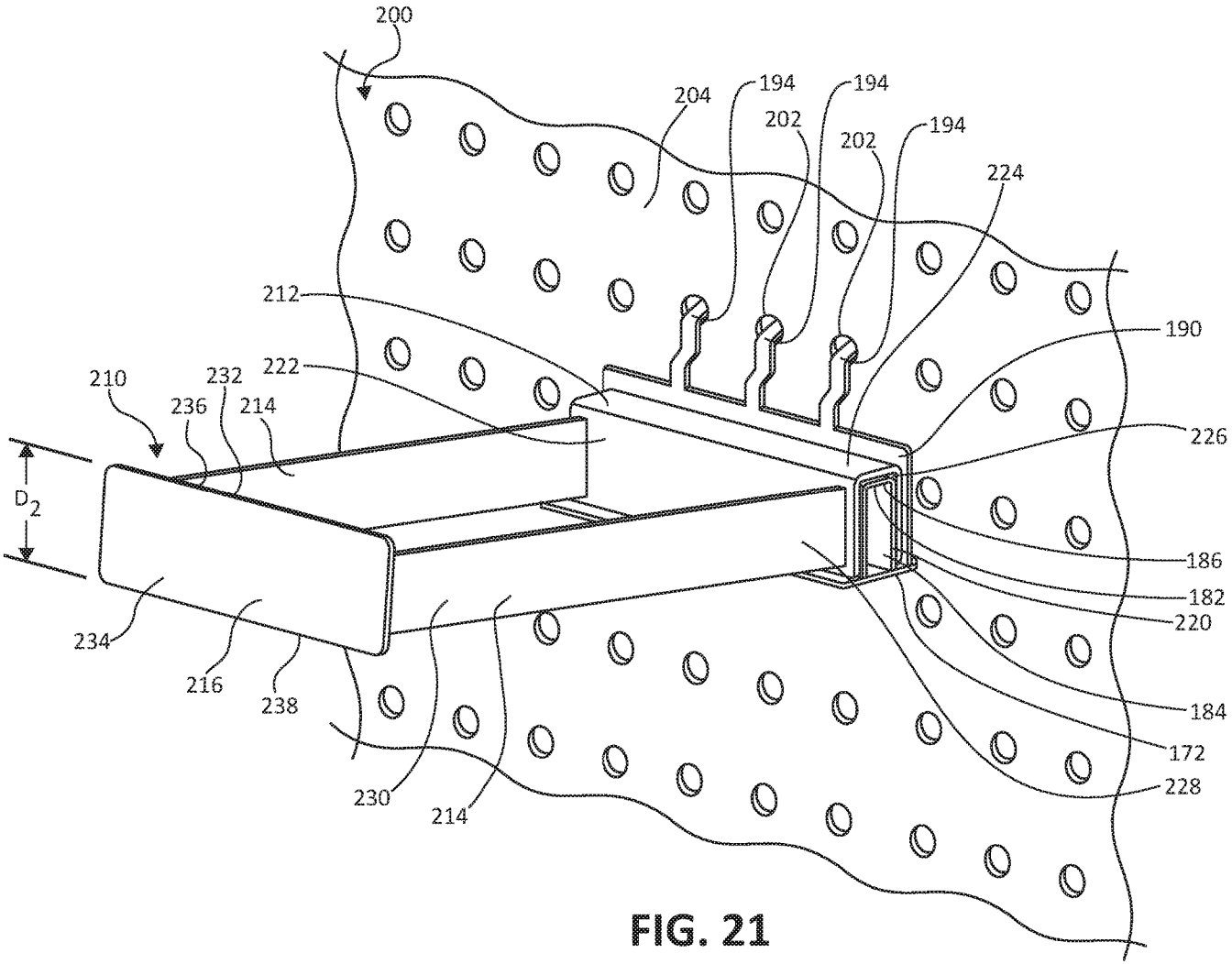
FIG. 21 is a front perspective view illustration of the mounting member and fixture support panel of FIG. 18, and another mounting member, according to one embodiment of the present invention.

FIG. 21 illustrates use of mounting member 170 in the hanging configuration with another connection component or mounting member 210, according to one embodiment of the invention. Mounting member 170 is hung substantially identically to the description of FIGS. 18 and 19 above. However, instead of receiving mounting member 100 via U-shaped protrusion 180, mounting member 210 is received via U-shaped protrusion 180. In one example, mounting member 210 includes an inverted U-shaped back support 212, side panels 214, and front plate 216. U-shaped back support 212 includes a first depending panel 220 opposite and substantially parallel to a second depending panel 222 where each depending panel 220 extends downwardly from opposing edges of top panel 224 of U-shaped back support 212.

U-shaped back support 212 defines an open channel 226 between depending panels 220 and 222 open opposite top panel 224. Open channel 226 is sized and shaped to snugly fit over U-shaped protrusion 182 of mounting member 170 or support cross bar 16 of display fixture 14 (FIG. 2) in a manner allowing a remainder of mounting member 210 to extend therefrom in a cantilevered fashion. Each of side panels 228 extends forwardly from, e.g., substantially perpendicularly relative to second depending panel 222, a different end of second depending panel 222. A length of side panels 228 is selected to provide a desired offset for sign holder assembly 12 (FIGS. 1-6) from pegboard panel 200 and, in one embodiment, is greater than about 6 inches, for example, to accommodate or highlight products hung from rods or other supports extending forwardly from pegboard panel 200. The length of side panels 228 is defined between a first end 228 adjacent U-shaped back support 212 and a second or opposite end 230 adjacent front plate 216.

Front plate 216 is substantially planar and coupled to ends of side panels 214 opposite U-shaped back support 212. More specifically, in one embodiment, front plate 246 defines a back surface 232, which interfaces with side panels 228, and an opposite front surface 234 each extending between a top edge 236 and an opposite, bottom edge 238 of front plate 216. A distance $D_2$ is defined between top edge 236 and bottom edge 238 such that front plate 216 is sized and shaped for reception within reception tracks 58 (FIGS. 2 and 3) of sign holder assembly 12, where distance $D_2$ is just less than distance $D_1$ of each reception track 58.

Figure 22:
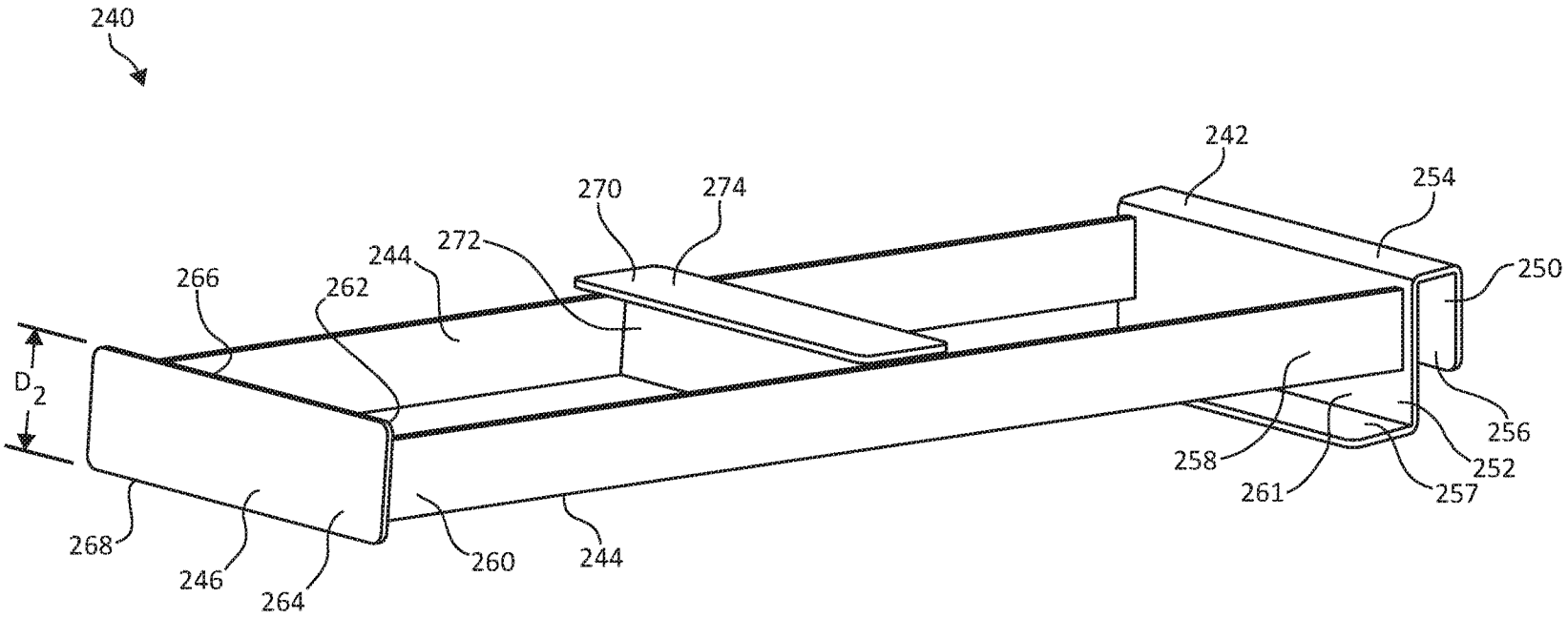
FIG. 22 is a front perspective view illustration of a mounting member, according to one embodiment of the present invention.

FIG. 22 illustrates another, for example, a fifth, connection component or mounting member 240. Mounting member 240 is configured for use similar to mounting member 210 but is configured for longer offsets from pegboard 200 and includes additional features to facilitate storage of mounting member 240. More specifically, mounting member 240 includes a back support 242, side panels 244, and a front plate 246. Back support 242 includes a first depending panel 250 opposite and substantially parallel a second depending panel 252 each extending downwardly from opposing edges of top panel 254 of back support 242. Depending panels 250 and 252 and top panel 254 collectively define an open channel 256 therebetween and open opposite top panel 254. Open channel 256 is sized and shaped to snugly fit over U-shaped protrusion 182 of mounting member 170 (FIGS. 17-21) or support cross bar 16 of display fixture 14 (FIG. 2) in a manner allowing a remainder of mounting member 240 to extend forwardly therefrom in a cantilevered fashion. In one example, first depending panel 252 extends further from top panel 254 than second depending panel 250. A return panel 257 extends from an end of depending panel 252 opposite top panel 254 forwardly (i.e., away from first depending panel 252) to be substantially parallel to top panel 254.

Each of side panels 244 extends forwardly from, e.g., substantially perpendicularly relative to second depending panel 252, of second depending panel 252 between a first end 258 to a second end 260. First end 258 of each side panel 244 is spaced from return panel 257 to define a storage channel 261 therebetween on a side of second depending panel 252 opposite first depending panel 250. A length of side panels 244 is selected to provide a desired offset for sign holder assembly 12 (FIGS. 1-6) from pegboard panel 200 (FIGS. 18 and 21) and, in one embodiment, is greater than about 8 inches, for example, to accommodate or highlight products hung from rods or other supports extending forwardly from pegboard panel 200.

In one embodiment, a support brace 270 extends between side panels 244 at a position located between back support 242 and front plate 246, for example, about half way between back support 242 and front plate 246. Support brace 270 may have any number of configurations, and, in one example, includes a first segment 272 and a second segment 274 in a substantially L-shaped configuration. First segment 272 has a similar height as side panels 244 and extends substantially perpendicular to side panels with top and bottom edges of first segment 272 and side panels 244 aligning. Second segment 274 extends substantially perpendicularly relative to first segment 272 and side panels 244, for example, over edges of each of first segment 272 and side panels 244. Support brace 270 is configured to provide additional structural stability to mounting member 240.

Front flange or front plate 246 is substantially planar and coupled to second ends 260 of side panels 244 opposite back support 242. More specifically, in one embodiment, front plate 246 defines a back surface 262, which interfaces with side panels 244, and an opposite front surface 264. Front plate 246 defines a top edge 266 and an opposite, bottom edge 268. A distance $D_2$ is defined between top edge 266 and bottom edge 268 such that front plate 246 is sized and shaped for reception within reception tracks 58 (FIGS. 2 and 3) of sign holder assembly 12, where distance $D_2$ is just less than distance $D_1$ of each reception track 58.

Figure 23:
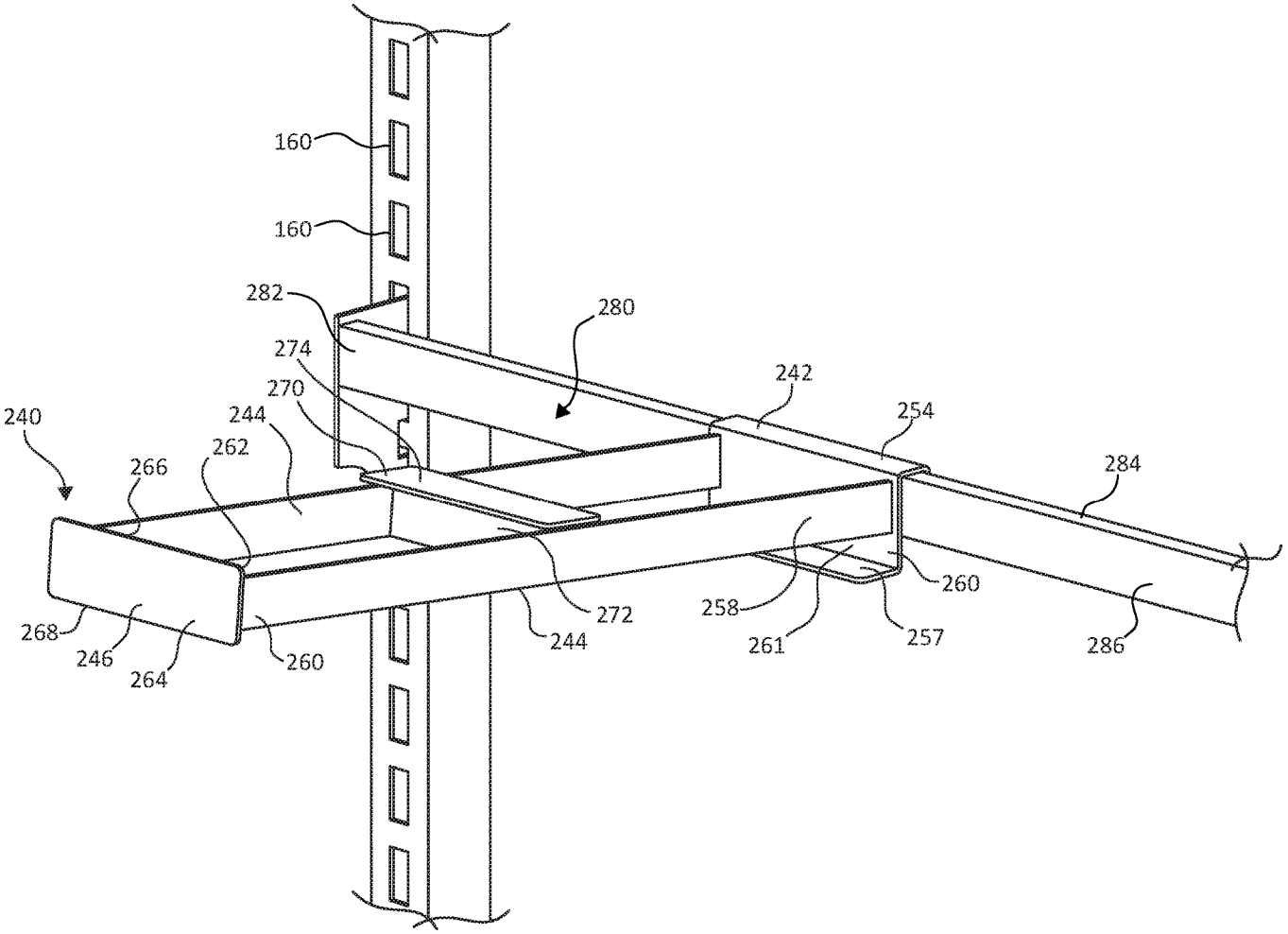
FIG. 23 is a front perspective view illustration of a mounting member coupled to a support structure, according to one embodiment of the present invention.
Figure 24:
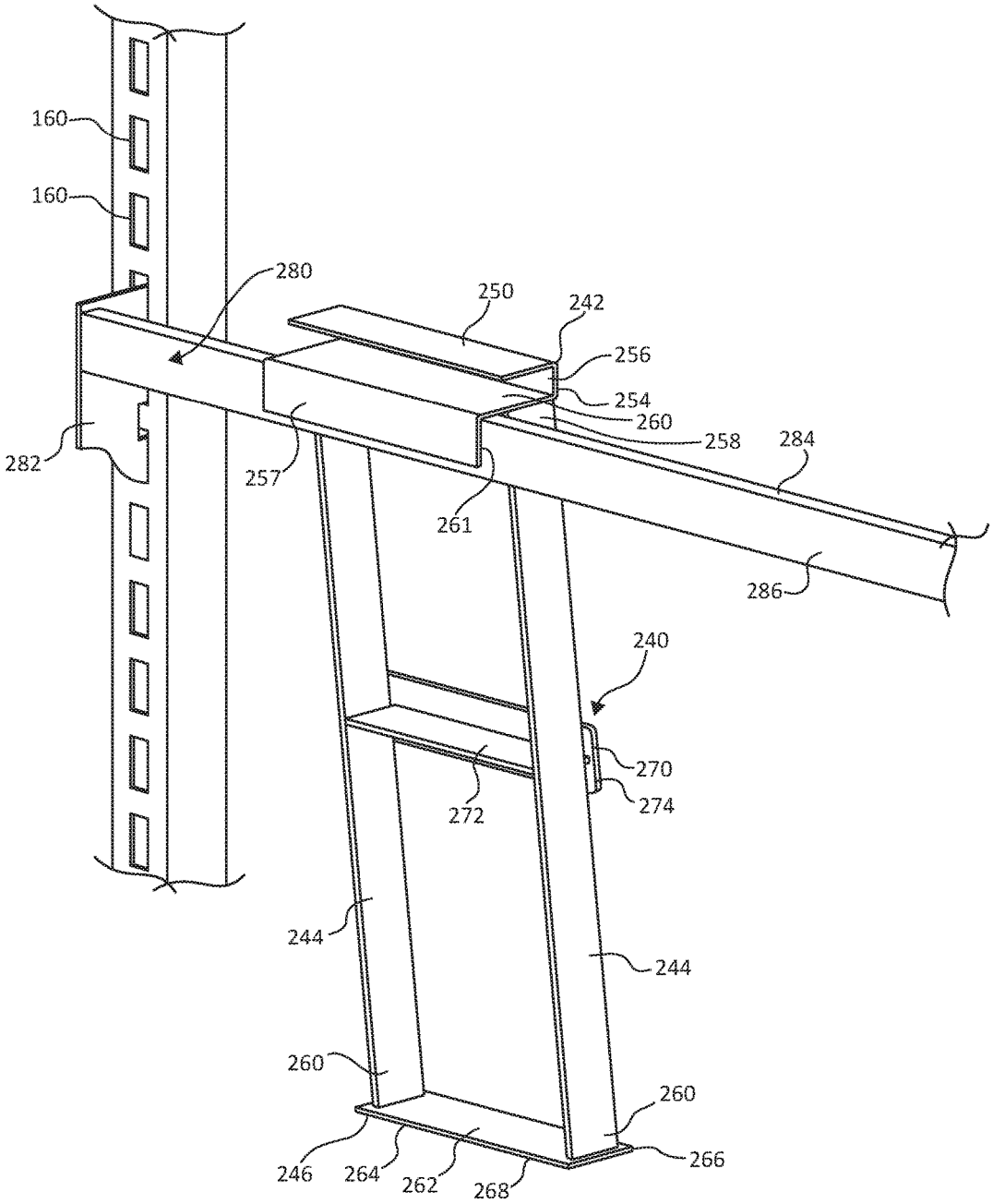
FIG. 24 is a front perspective view illustration of the mounting member coupled to the support structure of FIG. 23, according to one embodiment of the present invention.

FIGS. 23 and 24 illustrate mounting member 140 interaction with a support bar 280 of a display fixture in each of a use position and a storage position, respectively. For example, support bar 280 includes end brackets 282 and defines a top surface 284 and opposite side surfaces 286 extending downwardly from top surface 284. During use, mounting member 240 is positioned such that support bar 280 is snugly received within open channel 256 such that first depending panel 150, top panel 252, and second depending panel 25 respectively interact directly with a side surface (not shown), top surface 284, and side surface 286. In this manner, mounting member 240 extends forwardly from support bar 280 or other support bar in a display fixture such as, in one example, support cross bar 16 (FIG. 2). Sign support assembly 12 slides onto mounting member 240 by sliding reception track 58 over front plate 246, for example, in a similar manner as described for other mounting members above.

Figure 25:
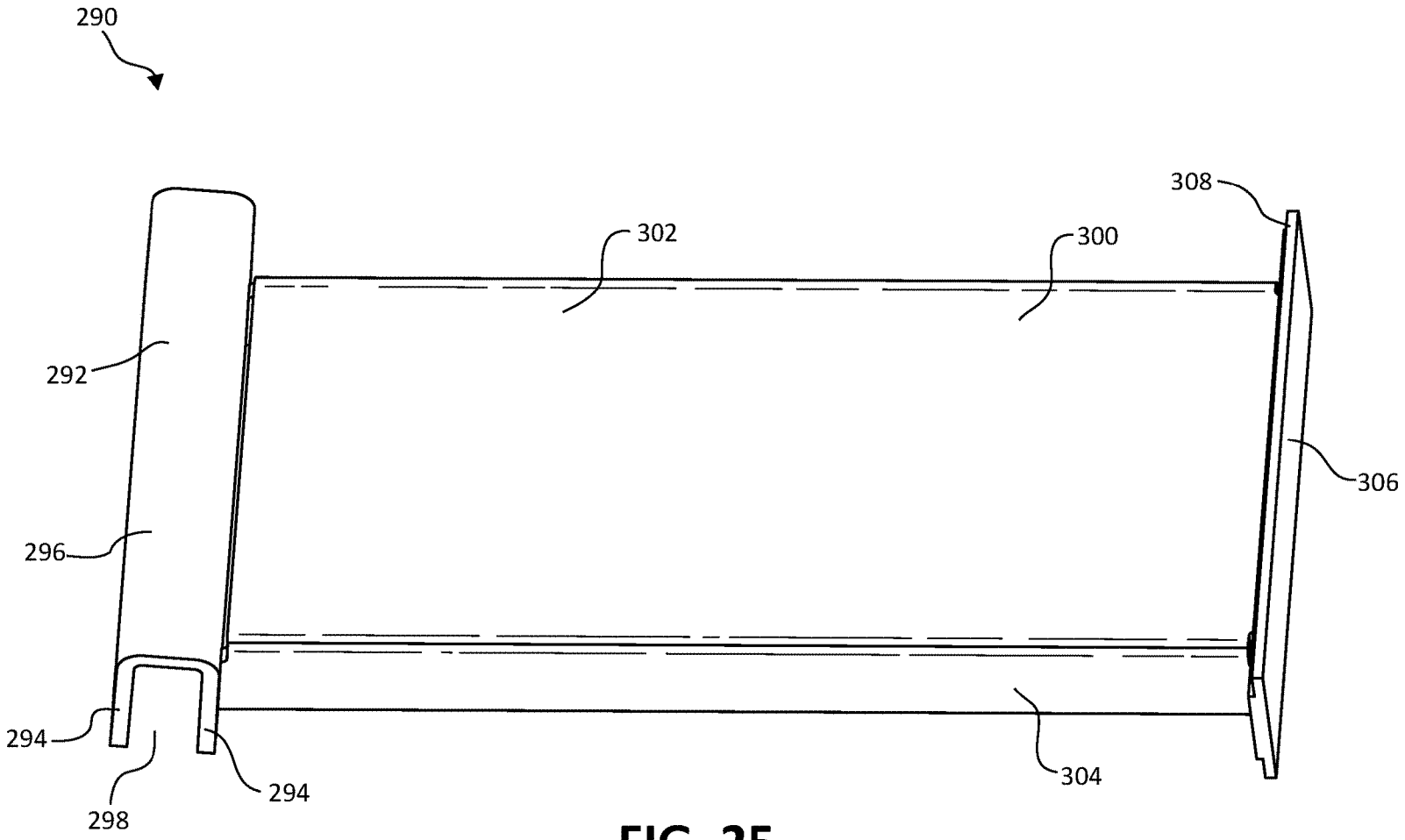
FIG. 25 is a side perspective view illustration of a mounting member, according to one embodiment of the present invention.
Figure 26:
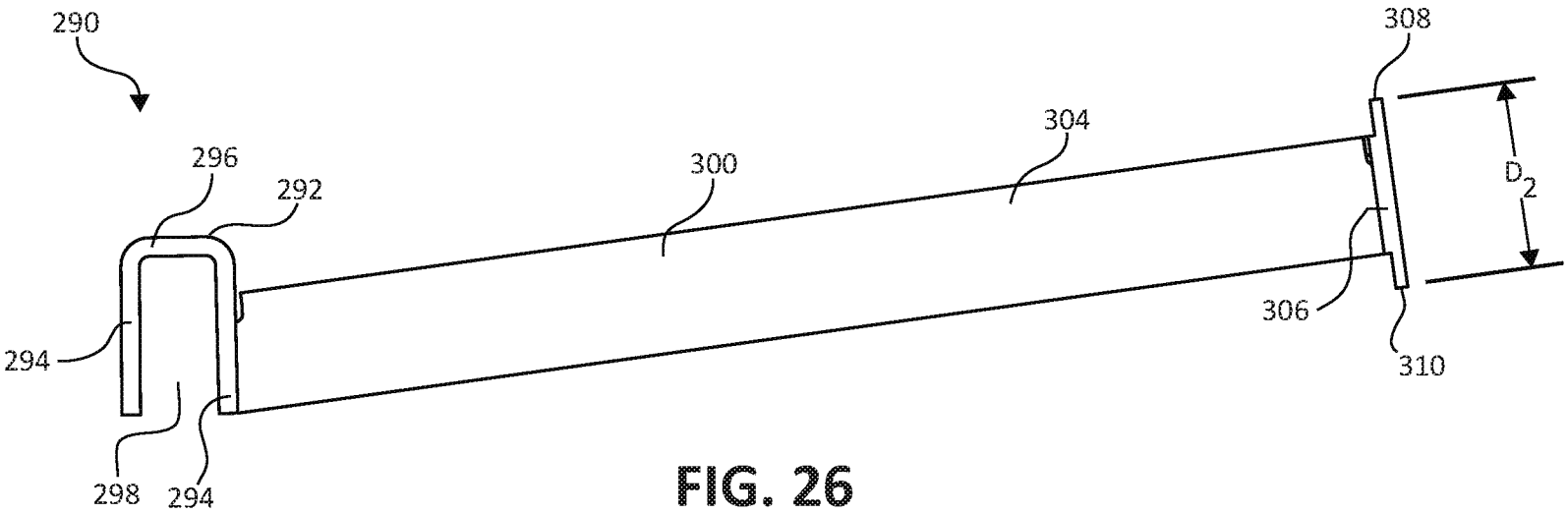
FIG. 26 is a left side view illustration of the mounting member of FIG. 25, according to one embodiment of the present invention.

FIGS. 25 and 26 illustrate another, e.g., a sixth, mounting member 290. Mounting member 290 includes a back support 292, an extension segment 300, and a front flange or plate 306. Back support 292 has an inverted, substantially U-shape similar to substantially U-shaped back support 212 of mounting member 210 (FIG. 21) including opposing depending panel 294 and a top panel 296 extending between depending panels 294 to define an open channel 298 sized and shaped to snugly fit over a portion of another mounting member or of a display fixture. Extension segment 300 extends forwardly from back support 292, for example, one of depending panels 294. A length of extension segment 300 is selected to provide a desired offset for sign holder assembly 12 (FIGS. 1-6) from a supporting cross bar and, in one embodiment, is greater than about 6 inches, for example, to accommodate or highlight products hung from the corresponding supporting cross bar. In one embodiment, extension segment 300 has an inverted, U-shaped cross section to increase overall strength of mounting member 290. Extension segment 300 defines a top or primary panel 302 with a side panel 304 extending downwardly from each of opposing longitudinal edges of primary panel 302.

Front plate 306 is substantially planar and coupled to an end of extension segment 300 opposite back support 292. More specifically, in one embodiment, front plate 306 defines a top edge 308 and an opposite, bottom edge 310. Distance $D_2$ is defined between top edge 308 and bottom edge 310 such that front plate 306 is sized and shaped for reception within reception tracks 58 (FIGS. 2 and 3) of sign holder assembly 12, where distance $D_2$ is just less than distance $D_1$ of each reception track 58. Accordingly, during use, back support 292 is placed over a supporting cross member and extends forwardly therefrom to receive sign holder assembly 12 on an opposite end of mounting member 290. In one example, extension segment 300 is non-perpendicular in its extension from back support 292, thereby, varying the angle of presentation of sign holder assembly 12 as compared to other mounting members, for example, mounting members 210 (FIG. 21) and 240 (FIGS. 22-24) extending substantially perpendicularly and forwardly relative to supporting structure.

Figure 27:
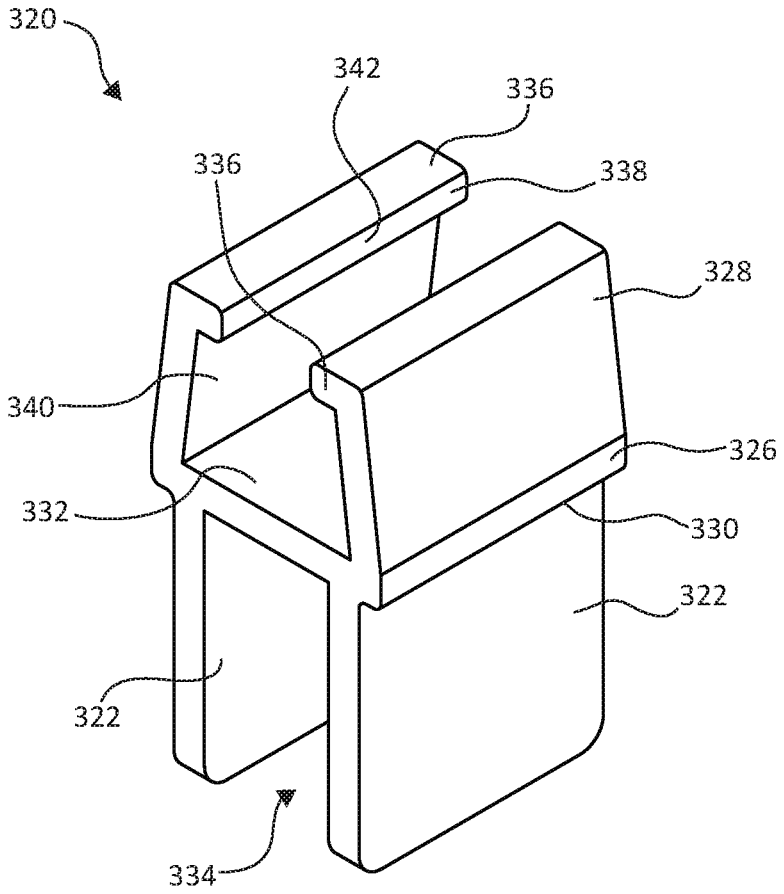
FIG. 27 is a perspective view illustration of a mounting member, according to one embodiment of the present invention.

FIG. 27 illustrates one embodiment of another, for example, a seventh, connection component or mounting member 320. Mounting member 320 includes two parallel coupling panels 322, a cap panel 324, and two angled side panels 328. Cap panel 324 extends substantially horizontally, and each of coupling panels 322 depends from opposing sides of a bottom surface 330 of cap panel 324 spaced from and substantially parallel to one another to define an open channel 224 therebetween. Each of coupling panels 322 and cap panel 324 are substantially planar, in one example.

Angled side panels 328 extend from opposing side edges of a top surface 332 of cap panel 326 in a direction upwardly and inwardly toward one another. Each of angled side panels 328 is topped by an inwardly extending flange 336 extending, for example, substantially parallel to cap panel 326, and defining an inside edge 338 opposite the corresponding angled side panel 328. An upper channel 340 is defined between angled side panels 328, cap panel 332, and inwardly extending flanges 336 and is sized and shaped to receive base member 24 of sign holder assembly 12. An upper opening 342 to upper channel 340 is defined between inside edge 338. In one example, mounting member 320 is formed as an extruded or injection molded plastic member.

Figure 28:
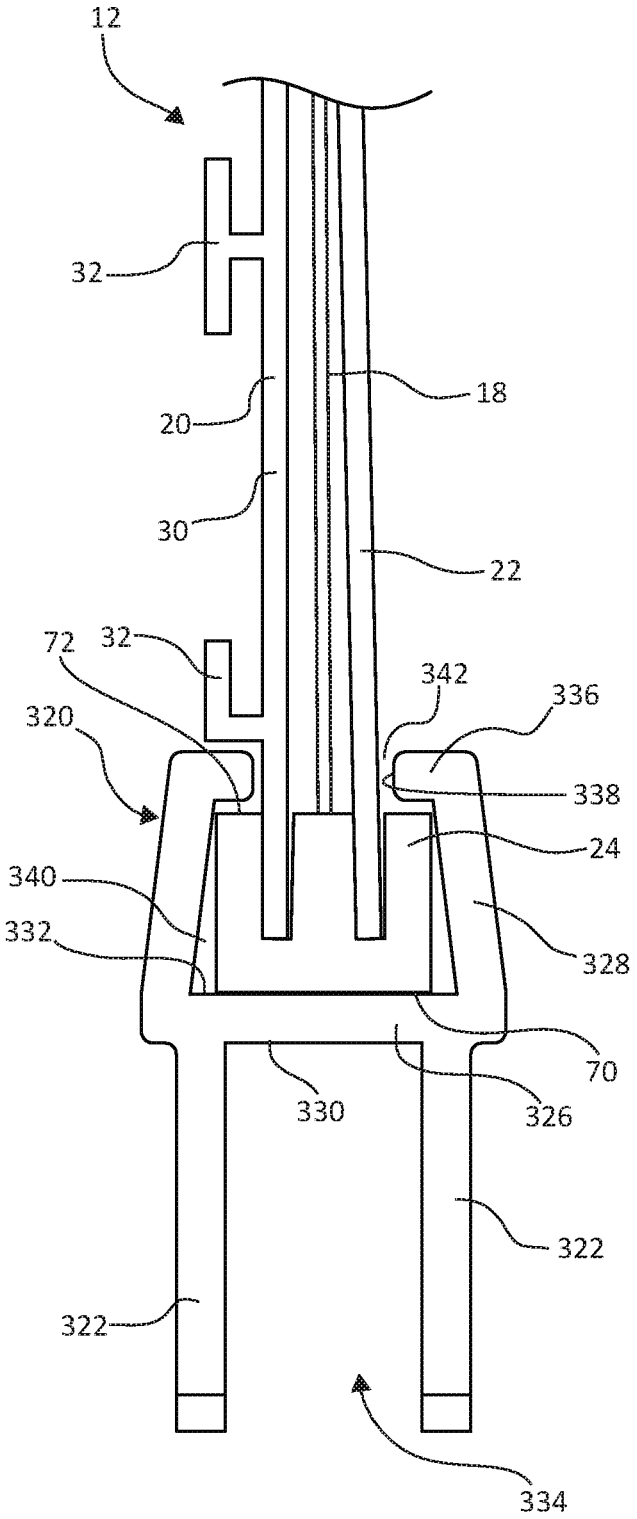
FIG. 28 is a left side view illustration of the mounting member of FIG. 27 with the sign holder assembly and sign of FIG. 3, according to one embodiment of the present invention.
Figure 29:
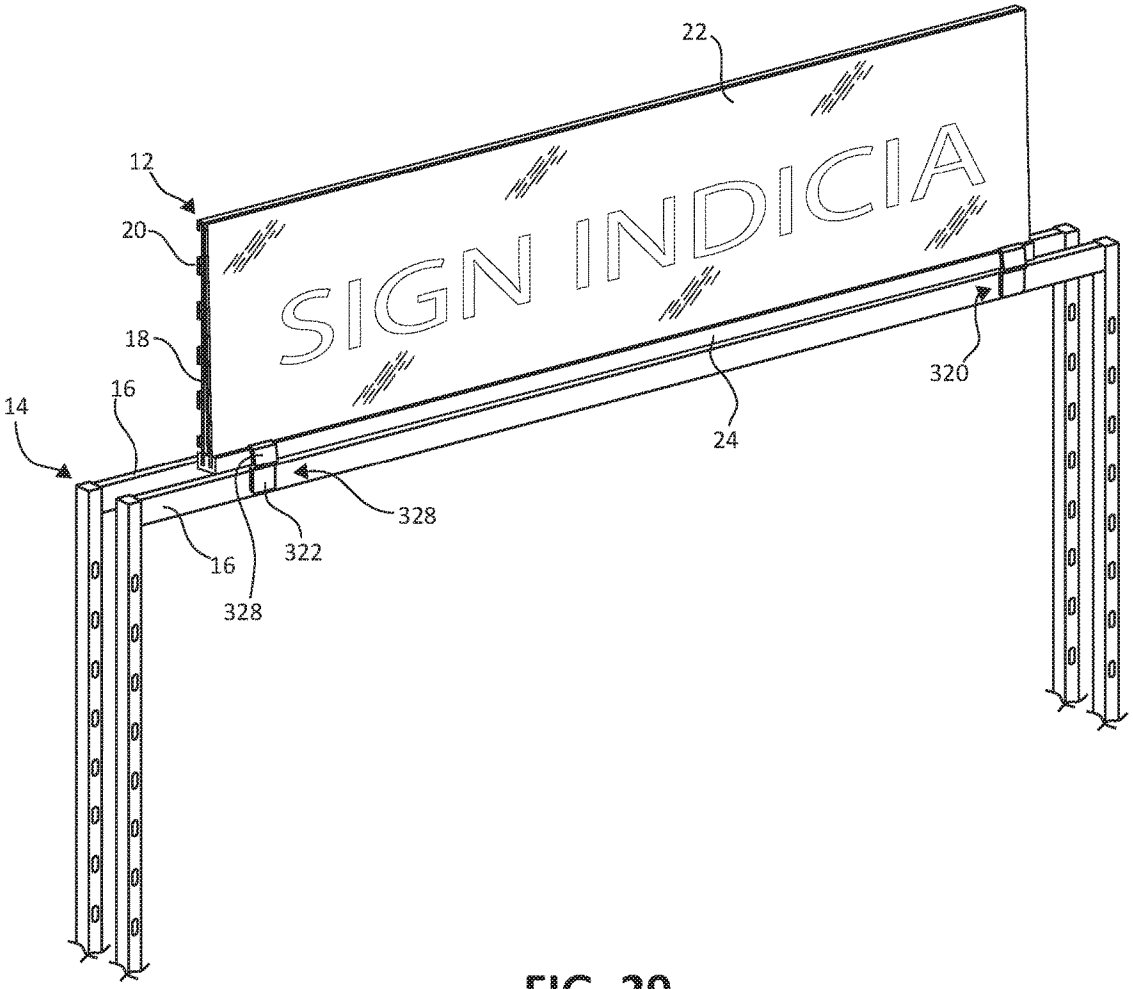
FIG. 29 is a front perspective view illustration of the sign holder assembly of FIG. 3 and the mounting member of FIG. 28, and a support fixture, according to one embodiment of the present invention.

Referring to FIGS. 28 and 29, during use, sign holder assembly 12 is slid into upper channel 340 of at least one mounting member 320, and in one example, is slid into upper channels 340 of two or more mounting members 320 spaced from one another to support opposing ends of sign holder assembly 12. As best illustrated in FIG. 28, a portion of base member 24 of sign holder assembly 12 fits within upper channel 340. More particularly, bottom surface 70 of base member 24 sits on top surface 332 of cap panel 326 and inwardly extending flanges 336 fit over a top surface 72 of base member 24 to hold base member 24 in upper channel 340. In this position, support member 20, cover member 22, and sign 28 extend from base member 24 out of upper channel 340 via upper opening 342. Referring primarily to FIG. 29, mounting members 320 each fit over support cross bar 16 of display fixture 14, more specifically, mounting members 320 receive cross bar 16 in lower channel 334 between parallel panels 322. Accordingly, mounting members 320 extend entirely above support cross bar 16.

Figure 30:
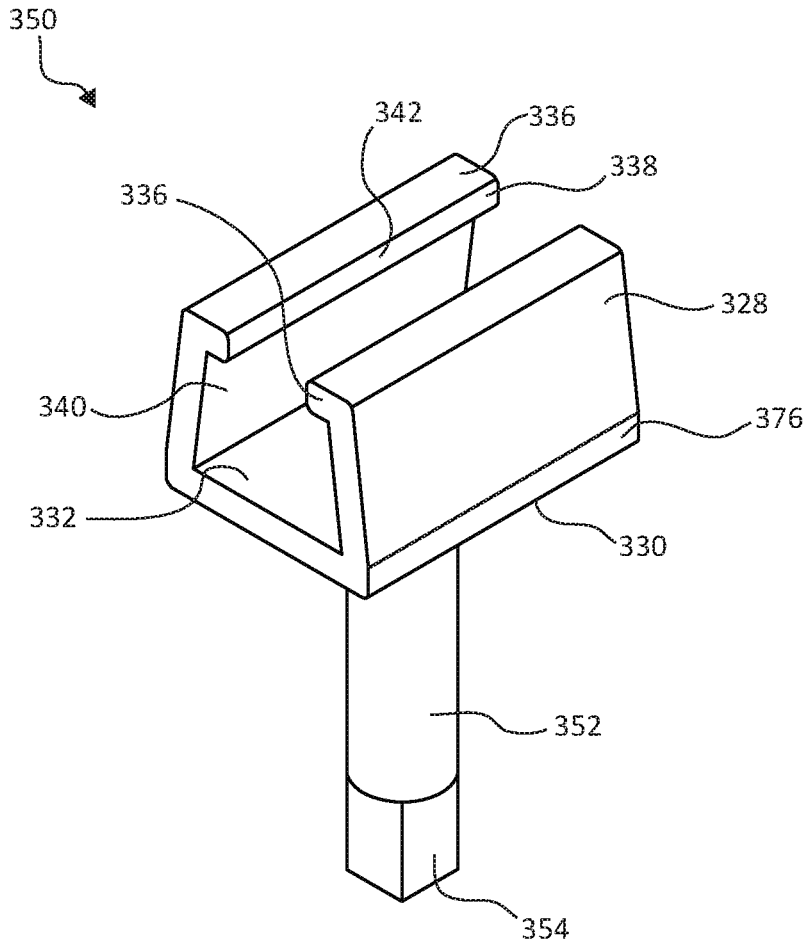
FIG. 30 is a perspective view illustration of a mounting member, according to one embodiment of the present invention.
Figure 31:
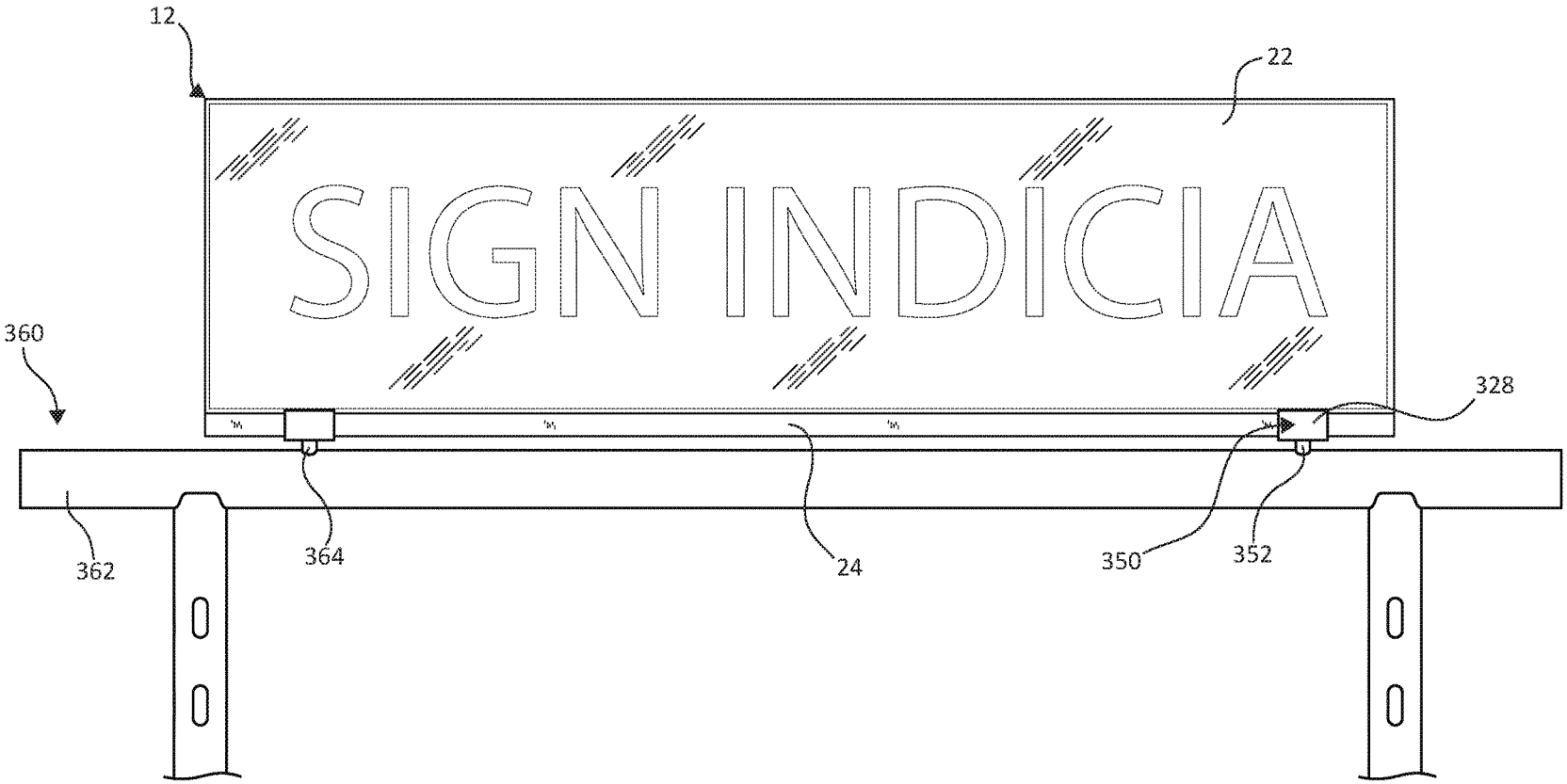
FIG. 31 is a front view illustration of the sign holder assembly of FIG. 3, the mounting member of FIG. 30, and a support fixture, according to one embodiment of the present invention.
Figure 32:
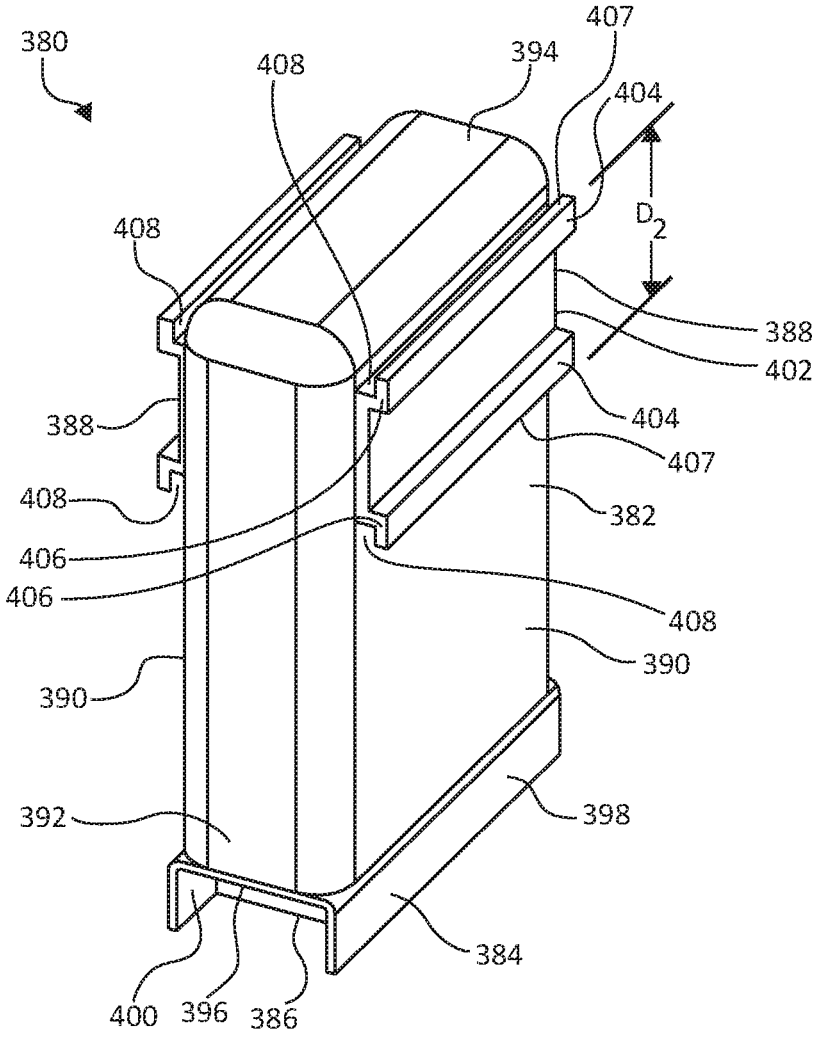
FIG. 32 is a front perspective view illustration of a mounting member, according to one embodiment of the present invention.

FIG. 30 illustrates another, for example, an eighth, connection component or mounting member 350. A top half of mounting member 350 is substantially similar to a top half of mounting member 320 such that mounting member 350 includes cap panel 326, angled side panels 328, and inwardly extending flange 338. Unlike mounting member 320, mounting member 350 includes a mounting peg 352 extending downwardly from bottom surface 330 of cap panel 326. In one example, mounting peg 352 is substantially cylindrical with a lower portion thereof forming a squared end 354 opposite cap panel 326. Referring to FIG. 32, mounting member 350 interacts with sign holder assembly 12 substantially identically to mounting member 320, but is configured to be coupled with an alternative display fixture 360 having a cylindrical or otherwise suitably shaped cross bar 362 and apertures 364 extending from a top surface of cross bar 362. Mounting peg 352 is sized and shaped to snuggly fit within one of apertures 364 to couple mounting member 250 to cross bar 362 such that sign holder assembly 12 is maintained substantially entirely above cross bar 362.

FIG. 32 illustrates still another, for example, a ninth, connection component or mounting member 380. Mounting member 380 includes a main body 382, a base 384, a magnet 386, and coupling rails 388. Main body 382 is generally a rectangular prism shape and defines opposing side surfaces 390, a bottom end 392, and a top end 394. Base 384 is, in one example, formed from bent sheet metal with an inverted U-shaped cross section to define a top panel 396, and opposing depending sidewalls 398 extending from opposing sides of top panel 396. Accordingly, a lower channel 400 is defined between top panel 396 and opposing depending sidewalls 398. A bottom end 392 of main body 382 is coupled to top panel 396 such that main body 382 extends upwardly from base 384. In one example, main body 382 and base 384 have substantially identical lengths and widths. Magnet 386 is sized and shaped to fit primarily within lower channel 400.

Each of coupling rails 388 is secured to a different one of opposing sidewalls 398 of main body 382. Each coupling rail 388 includes a primary panel 402, opposing flanges 404, and offset segments 406. Primary panel 402 is substantially planar and rectangular. Offset segments 406 extend outwardly from opposing longitudinal edges of primary panel 402, for example, in a direction substantially perpendicular to primary panel 402. Each opposing flange 404 extends from a different one of offset segments 406 opposite and substantially parallel to primary panel 402 to a free end 407. As such, offset segments 406 space flanges 404 from sidewalls 398 to form top and bottom channels 408 on opposites sides of each of coupling rails 388. Free edges 407 of each coupling rail 388 are spaced apart distance $D_2$ such that coupling rail 388 is configured to fit within one of reception channels 58 of sign holder assembly 12.

Figure 33:
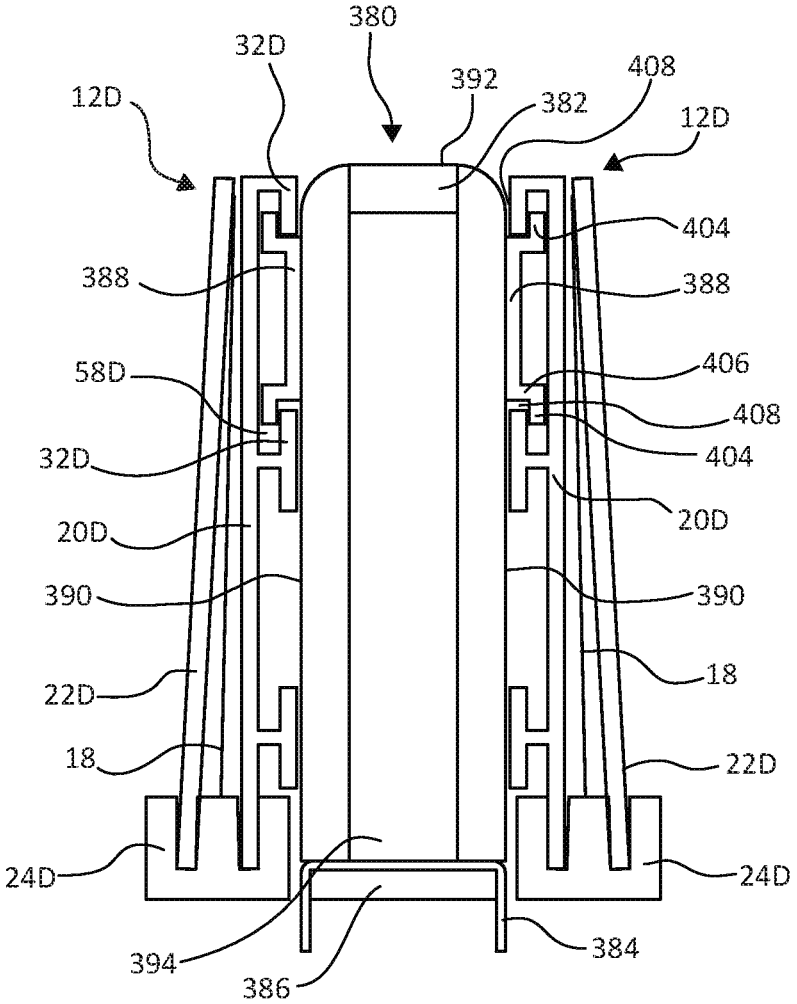
FIG. 33 is a right side view illustration of the mounting member of FIG. 32 with two sign holder assemblies, according to one embodiment of the present invention.
Figure 34:
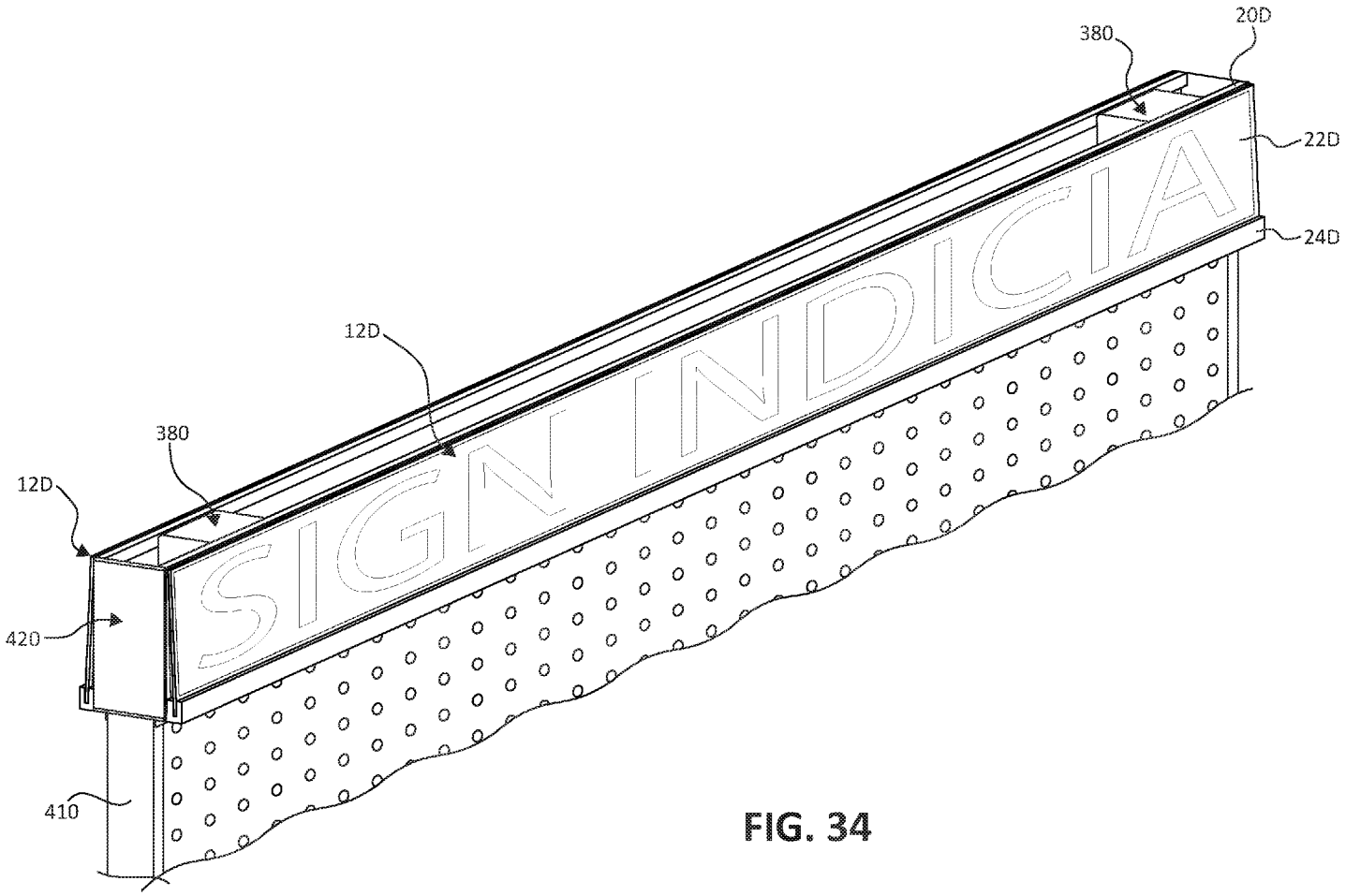
FIG. 34 is a front perspective view illustration of two mounting members, two sign holder assemblies, and two end caps installed on a retail display fixture, according to one embodiment of the present invention.

During use of mounting member 380, mounting member 380 is placed on a top spine (not shown) of a gondola fixture 410 as generally illustrated in FIG. 34. Magnet 386 facilitates securement of mounting member 380 to top spine of gondola fixture 410 where top spine is generally metallic and sidewalls 398 of base 384 fit on either side of the top spine. In one example, one of mounting members 380 is placed near opposing ends of the top spine of gondola fixture 410. Sign assembly 12 is coupled to mounting members 380 by sliding selected ones of reception tracks 58 of sign holder assembly 12D over corresponding coupling rails 388. Since mounting member 380 includes two opposing coupling rails 388, each mounting member 380 is capable of supporting two sign holder assemblies 12D, one on each side of mounting member 380 as illustrated, for example, in FIG. 33.

Figure 35:
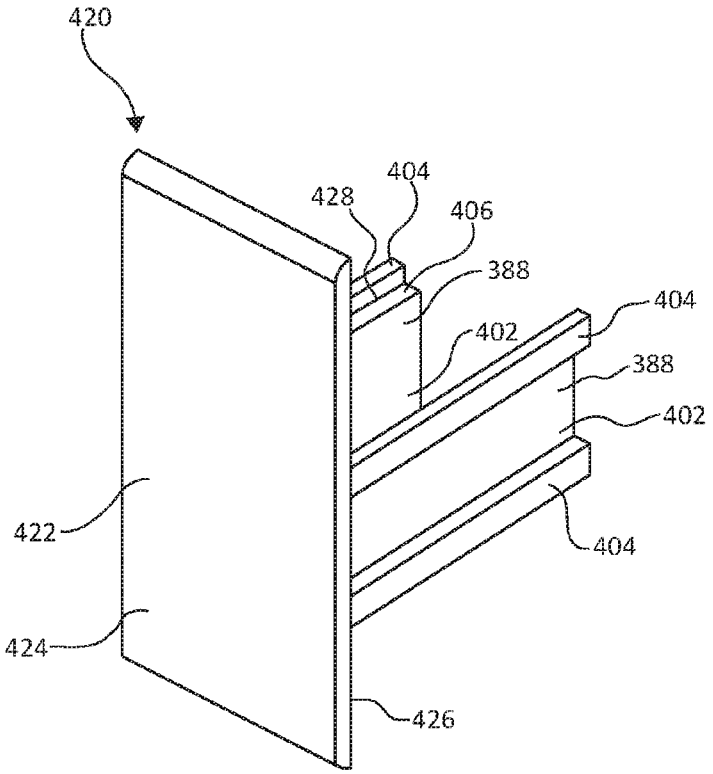
FIG. 35 is a front perspective view illustration of an end cap of FIG. 34, according to one embodiment of the present invention.
Figure 36:
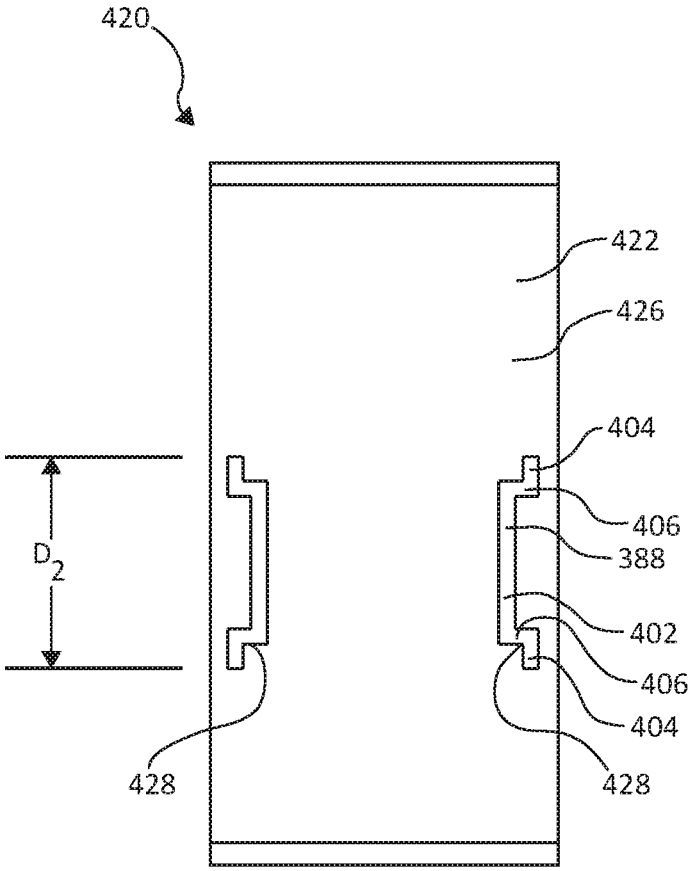
FIG. 36 is a side view illustration of the end cap of FIG. 35, according to one embodiment of the present invention.

Referring to FIGS. 34-36, in one example, mounting members 380 are used with one or more end caps 420 to extend between the opposing sign holder assemblies 12D and provide a clean end view to the resulting retail display. In one embodiment, each mounting member 380 includes an end panel 422 two opposing coupling rails 388 substantially identical to coupling rails 388 of mounting members 380. End panel 422 is substantially planar and defines an exterior surface 424 and an interior surface 426 opposite exterior surface 424. Each coupling rail 388 extends inwardly from interior surface 426 of end panel 422 and is inwardly offset from side edges of end panel 422, for example, as illustrated in FIG. 36. Open channels 428 are defined by inside surfaces of offset segments 406 and flanges 404 and are each configured to receive an edge of one cross member 52 of sign holder assembly 12D. During use, coupling rails 388 of end cap 420 fits with a selected reception track 58 of each of two opposing sign holder assemblies 12D over an end of each sign holder assembly 12D. More specifically, in one embodiment, end cap 420 is slid relative to sign holder assemblies 12D such that only end panel 422 is visible upon assembly as shown in FIG. 34.

Figure 37:
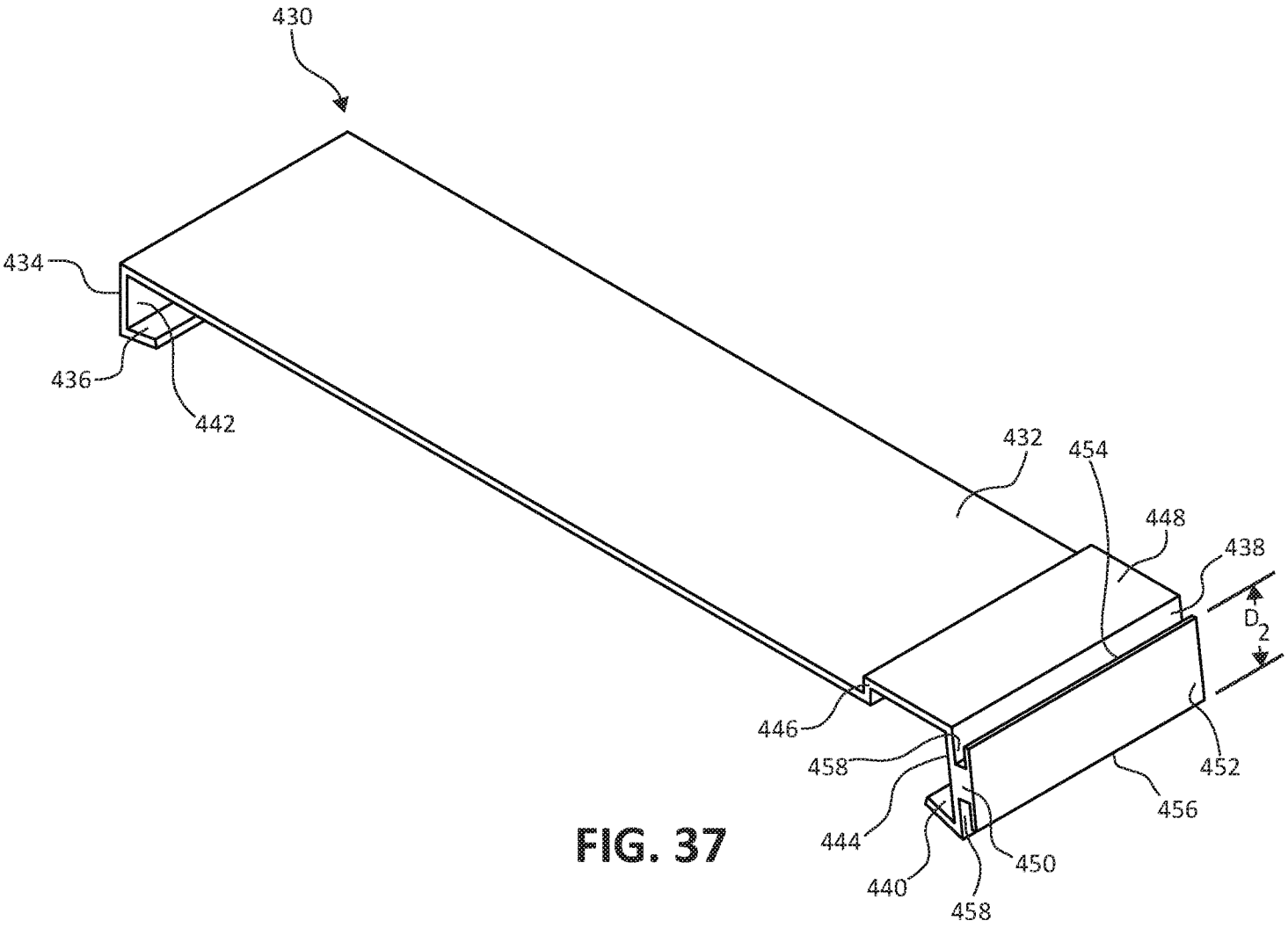
FIG. 37 is a front perspective view illustration of a mounting member, according to one embodiment of the present invention.
Figure 38:
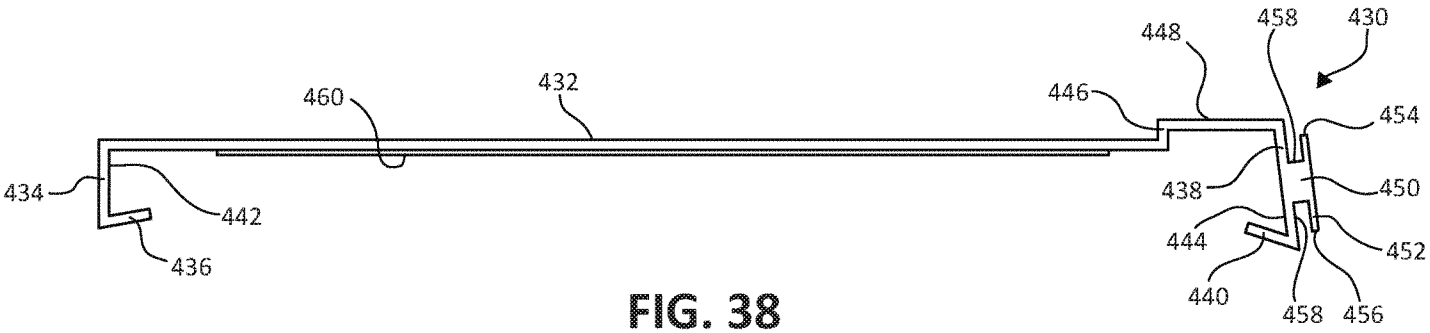
FIG. 38 is a left side view illustration of the mounting member of FIG. 37, according to one embodiment of the present invention.
Figure 39:
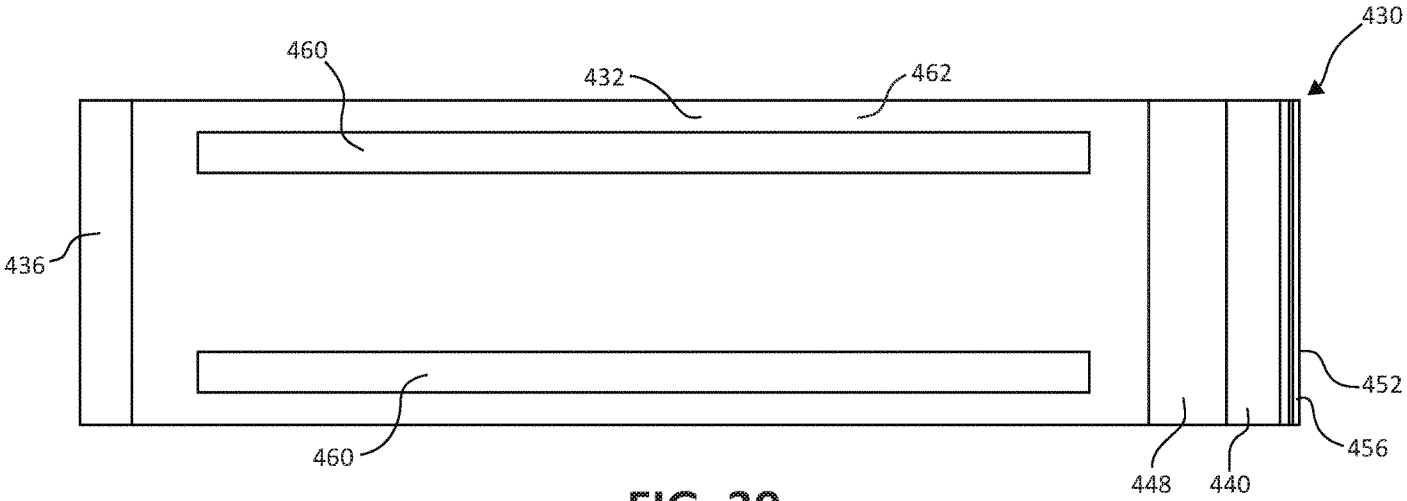
FIG. 39 is a bottom view illustration of the mounting member of FIG. 37, according to one embodiment of the present invention.
Figure 40:
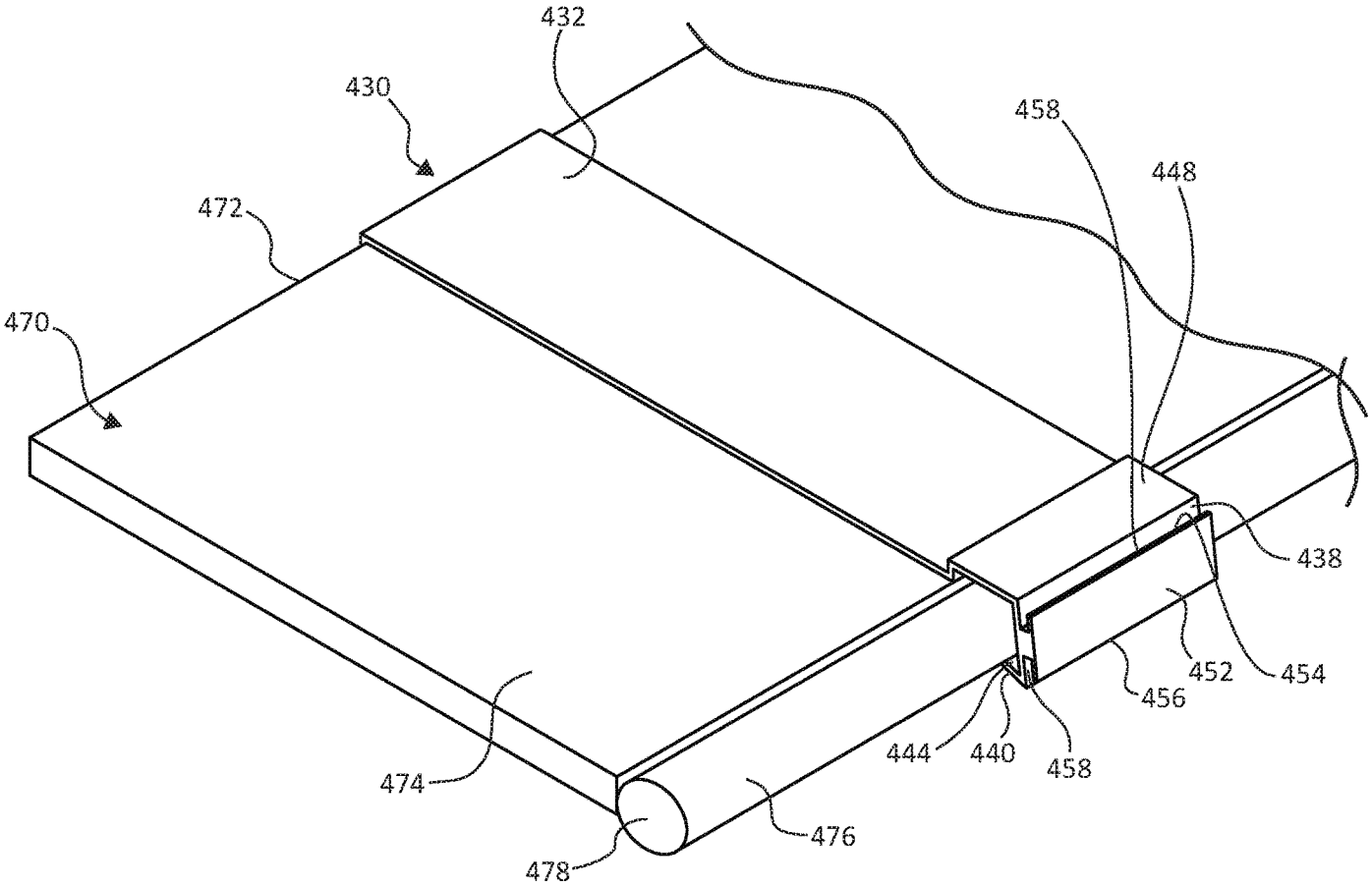
FIG. 40 is a front perspective view illustration of the mounting member of FIG. 37 installed on a retail display fixture shelf, according to one embodiment of the present invention.

FIGS. 37-39 illustrate another, e.g., a tenth, connector component or mounting member 430. Mounting member 430 includes a primary panel 432, a back panel 434, back bottom flange 436, front panel 438, and a front bottom flange 440. Primary panel 432 is substantially planar and extends between back panel 434 and front panel 438. In one example, back panel 434 extends downwardly and, for instance, substantially perpendicularly relative to primary panel 432 in a planar manner. Back bottom flange 436 extends from an edge of back panel 434 opposite primary panel 432 forwardly in a direction substantially parallel to primary panel 432 to define a back channel 442 between back bottom flange 436 and primary panel 432 adjacent back panel 434.

In one embodiment, front panel 438 extends downwardly and, for instance, substantially parallel to back panel 434 from an edge of primary panel 432 opposite back panel 434. Front bottom flange 440 extends from an edge of front panel 438 opposite primary panel 432 rearwardly and, for instance, substantially parallel to primary panel 432 to define a front channel 444 between front bottom flange 440 and primary panel 432 adjacent front panel 438. In one example, primary panel 432 includes an offset segment 446 extending slightly upwardly from primary panel 432 to an upper panel segment 448. Upper panel segment 448 extends from offset segment 446 to front panel 438.

In one embodiment, mounting member 430 includes a protrusion bar 450 extending forwardly from front panel 438, for example, in a substantially horizontally extending manner. Protrusion bar 450 has a height less than about one third of a height of front panel 438. Front plate 452 is substantially planar and rectangular and is coupled to a side of protrusion bar 450 opposite front panel 438. Front plate 452 defines a height (or has a distance $D_2$) extending between a top edge 454 and a bottom edge 456 of front plate 452 that is substantially larger than the height of protrusion bar 450 such that top and bottom channels 458 are defined on either side of protrusion bar 450 between front panel 438 and front plate 452.

Mounting member 430 is configured to couple sign holder assembly 12 to a display shelf 470 having a back edge 472, a top surface 474, and a front edge 476 opposite back edge 472. In one example, display shelf 470 includes a cylindrical tube 478 longitudinally extending along front edge 476 of display shelf 470. Mounting member 430 fits on top of display shelf 470 such that primary panel 432 extends over top surface 474 of shelf 470, back edge 472 of display shelf 470 is positioned in back channel 442 of mounting member 430, and front edge 476, more particularly, cylindrical tube 478, is positioned in front channel 444 of mounting member 430. Each of back bottom flange 436 and front bottom flange 440 are biased toward a bottom surface (not shown) of display shelf 470 to hold mounting member 420 on display shelf 470. In one embodiment, rubber strips 460 are secured to a bottom surface 462 of primary panel 432 to interact with top surface 474 of display shelf 470 helping to decrease inadvertent sliding and further hold mounting member 430 on display shelf 470. Once so positioned on shelf 470, mounting member 430 receives sign support assembly 12 by sliding reception track 58 of sign support assembly 12 over front plate 452. Accordingly, sign support assembly 12 is maintained in front of front edge 476 of display shelf 470.

In view of the above, the present invention provides a family of sign holder assemblies 12, 12B, 12C, and 12D and mounting members 100, 130, 170, 210, 240, 290, 320, 350, 380, and 430 as well as similar such sign holder assemblies and mounting members that will be apparent to those of skill in the art after reading this application. The family of sign holder assemblies and mounting members is configured to interchangeably work with one another to couple signs to various display fixtures while keeping the total number of parts used for mounting signs to various fixtures at a low number, thereby, decreasing overall part inventory maintained for possible use in a retail setting. In addition, use of similar sign holder assemblies on various types of display fixtures allows for a more consistent aesthetic look for an entire department in a retail store or setting or even of the entirety of the retail store. In addition the disclosed family of sign holder assemblies and mounting members generally provides for attachment to retail displays without the use of tools or other fasteners.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A sign holder assembly comprising:

a cross bar secured in a retail display;

a mounting member selectively coupled with the cross bar, the mounting member comprising:

a front panel, at least two elongated reception channels extending substantially in parallel with each other and the front panel, wherein each of the at least two elongated reception channels is open toward a first direction and is sized and shaped to sit over and extend at least partially around the cross bar to couple the mounting member to the cross bar, a first flange offset from and extending substantially parallel to the front panel, the first flange defining a free top edge of the mounting member, and a second flange being substantially coplanar with and extending in an opposite direction as the first flange to define a free bottom edge of the mounting member opposite the free top edge, wherein the first flange and the second flange are configured to collectively receive a sign holder support member on an opposite side of the front panel as compared to the at least two elongated reception channels;

wherein the mounting member includes an intermediate panel extending between and positioned immediately adjacent each of two of the at least two elongated reception channels.

2. The sign holder assembly of claim 1, wherein the intermediate panel extends substantially parallel with each of the first flange, the second flange, and the front panel.

3. The sign holder assembly of claim 1, wherein the mounting member includes a rear panel extending substantially parallel to the front panel and the intermediate panel and forming a side of one of the at least two elongated reception channels opposite the intermediate panel.

4. The sign holder assembly of claim 1, wherein:

the mounting member includes a top panel extending substantially perpendicularly relative to the front panel, the first flange extends upwardly from an edge of the top panel, and the top panel is immediately adjacent each of the at least two elongated reception channels.

5. The sign holder assembly of claim 4, wherein:

each of the front panel and the intermediate panel extends directly from the top panel.

6. The sign holder assembly of claim 4, wherein:

the first flange extends directly from the top panel, the second flange is offset from the front panel via a flange offset extending forwardly from the front panel, and the second flange is spaced from the top panel.

7. The sign holder assembly of claim 1, wherein the mounting member is formed as a single piece separate from each of the cross bar and the sign holder support member.

8. The sign holder assembly of claim 1, wherein the first flange and the second flange are coplanar with each other.

9. A sign holder assembly comprising:

a cross bar secured in a retail display;

a mounting member selectively coupled with the cross bar, the mounting member comprising:

a front panel, at least two elongated reception channels extending substantially in parallel with each other and the front panel, wherein each of the at least two elongated reception channels is open toward a first direction and is sized and shaped to sit over and extend at least partially around the cross bar to couple the mounting member to the cross bar, a first flange offset from and extending substantially parallel to the front panel, the first flange defining a free top edge of the mounting member, and a second flange being substantially coplanar with and extending in an opposite direction as the first flange to define a free bottom edge of the mounting member opposite the free top edge, wherein the first flange and the second flange are configured to collectively receive a sign holder support member on an opposite side of the front panel as compared to the at least two elongated reception channels;

wherein:

the cross bar has a substantially rectangular cross-sectional shape, and each of the at least two elongated reception channels has a corresponding substantially rectangular cross-sectional shape.

10. A sign holder assembly comprising:

a sign holder support member;

a cross bar secured in a retail display;

a mounting member selectively coupled with the cross bar, the mounting member comprising:

a front panel, at least two elongated reception channels extending substantially in parallel with each other and the front panel, wherein each of the at least two elongated reception channels is open toward a first direction and is sized and shaped to sit over and extend at least partially around the cross bar to couple the mounting member to the cross bar, a first flange offset from and extending substantially parallel to the front panel, the first flange defining a free top edge of the mounting member, and a second flange being substantially coplanar with and extending in an opposite direction as the first flange to define a free bottom edge of the mounting member opposite the free top edge, wherein the first flange and the second flange are configured to collectively receive the sign holder support member on an opposite side of the front panel as compared to the at least two elongated reception channels;

wherein the sign holder support member includes:

a substantially planar panel longitudinally extending between a first end and a second end of the substantially planar panel, wherein the substantially planar panel has a first surface and a second surface opposite the first surface, and a plurality of rails rearwardly extending from the second surface of the substantially planar panel and being spaced vertically from one another, wherein the first flange is slidably received by one of the plurality of rails and the second flange is slidably received by a different one of the plurality of rails such that the sign holder support member is selectively coupled to the cross bar via the mounting member.

11. The sign holder assembly of claim 10, wherein:

the sign holder support member defines at least two reception tracks, each of the at least two reception tracks extending between a different pair of two adjacent ones of the plurality of rails, and each of the at least two reception tracks of the sign holder support member all have the same inside height dimension such that the first flange and the second flange are configured to be slidably received and selectively maintained by any one of the at least two reception tracks.

12. The sign holder assembly of claim 10, wherein:

the mounting member is a first mounting member, the sign holder assembly further comprises a second mounting member substantially identical to the first mounting member, and both the first mounting member and the second mounting member slidably couple with the sign holder support member via common ones of the plurality of rails.

13. The sign holder assembly of claim 10, further comprising a cover member that is substantially planar and substantially transparent, wherein the cover member is coupled to the sign holder support member to cover the first surface of the substantially planar panel such that the sign holder assembly is configured to maintain a sign between the cover member and the first surface of the substantially planar panel.

14. The sign holder assembly of claim 13, wherein:

the cover member has a bottom longitudinal edge and a top longitudinal edge opposite the bottom longitudinal edge, the sign holder assembly further comprises a base member including two elongated slots extending parallel to one another, the substantially planar panel defines and laterally extends between a top panel edge and a bottom panel edge, the bottom panel edge is received within one of the two elongated slots of the base member, the bottom longitudinal edge of the cover member is received within the other one of the two elongated slots of the base member such that the cover member has an angled orientation relative to the support member extending closer to the first surface of the substantially planar panel near the top longitudinal edge than near the bottom longitudinal edge, and each of the base member, the support member, and the cover member are formed as separate pieces.

15. The sign holder assembly of claim 13, in combination with the sign, wherein the sign is maintained between the front surface of the substantially planar panel and the cover member.

16. A mounting member for selectively coupling a sign holder to a cross bar, the mounting member comprising:

a front panel, at least two elongated reception channels extending in parallel with each other and the front panel, wherein each of the at least two elongated reception channels is open toward a first direction and is sized and shaped to independently sit over and extend at least partially around the cross bar to couple the mounting member to the cross bar, a first flange offset from and extending substantially parallel to the front panel, the first flange defining a free top edge of the mounting member, and a second flange extending in an opposite direction as the first flange to define a free bottom edge of the mounting member opposite the free top edge, wherein the first flange and second flange are substantially coplanar and configured to collectively receive a sign holder support member on an opposite side of the front panel as compared to the at least two elongated reception channels;

wherein:

the mounting member includes an intermediate panel extending between and positioned immediately adjacent each of two of the at least two elongated reception channels, and the intermediate panel extends substantially parallel with each of the first flange, the second flange, and the front panel.

* * * * *